US007827712B2

(12) United States Patent
Hines

(10) Patent No.: US 7,827,712 B2
(45) Date of Patent: Nov. 9, 2010

(54) LIGHTED SIGNAGE USING REFLECTED LIGHT BEHIND THE SIGNAGE

(76) Inventor: Stephen P. Hines, 1540 Wabasso Way, Glendale, CA (US) 91208

( * ) Notice: Subject to any disclaimer, the term of this patent is extended or adjusted under 35 U.S.C. 154(b) by 360 days.

(21) Appl. No.: 12/150,534

(22) Filed: Apr. 29, 2008

(65) Prior Publication Data

US 2008/0276507 A1 Nov. 13, 2008

Related U.S. Application Data

(63) Continuation-in-part of application No. 11/801,891, filed on May 11, 2007, now abandoned.

(51) Int. Cl.
*G09F 19/14* (2006.01)

(52) U.S. Cl. ..... 40/453; 40/442; 40/564; 352/100

(58) Field of Classification Search ..... 40/453, 40/454, 443; 352/100
See application file for complete search history.

(56) References Cited

U.S. PATENT DOCUMENTS 742,632 A * 10/1903 Hadden ..... 352/100
917,587 A * 4/1909 Good ..... 352/100
978,854 A * 12/1910 Czerniewski ..... 352/100
2,026,753 A * 1/1936 Rosenthal et al. ..... 352/100
2,299,731 A 10/1942 Arendt
3,653,753 A 4/1972 Mitchell
3,694,062 A 9/1972 Koenig
3,704,064 A 11/1972 Sollogoub et al.
3,743,394 A 7/1973 Meszlenyi
3,951,529 A 4/1976 Gandia
4,179,198 A * 12/1979 Brachet et al. ..... 352/100
4,383,742 A * 5/1983 Brachet et al. ..... 352/100
5,108,171 A 4/1992 Spaulding
6,169,368 B1 1/2001 Margelson et al.
6,353,468 B1 * 3/2002 Howard et al. ..... 352/100
6,443,590 B1 9/2002 Lovitt
6,466,183 B1 10/2002 Yamamoto et al.
6,564,486 B1 5/2003 Spodek et al.
6,870,596 B2 3/2005 Walker et al.
2005/0174539 A1 * 8/2005 Walker et al. ..... 352/100

* cited by examiner

*Primary Examiner*—Gary C Hoge
(74) *Attorney, Agent, or Firm*—Roy L. Anderson; Wagner, Anderson & Bright, LLP

(57) ABSTRACT

An apparatus and method for displaying back-lighted images to viewers moving along a path of travel past viewing boxes containing transparent images illuminated by substantially vertical light sources which are then reflected to obtain a shallow light box depth relative to the transparent images, the light sources being located behind the transparent images, relative to the viewer.

18 Claims, 25 Drawing Sheets

LIGHTED SIGNAGE USING REFLECTED LIGHT BEHIND THE SIGNAGE

CROSS REFERENCE TO RELATED APPLICATIONS

This application is a continuation-in-part application of U.S. patent application Ser. No. 11/801,891 filed May 11, 2007 now abandoned, the disclosure of which is specifically incorporated herein by reference.

FIELD OF THE INVENTION

The present invention is in the field of graphic displays viewed by persons rapidly moving past them, such as passengers in a subway car or a train.

BACKGROUND OF THE INVENTION

Advertising is a pervasive fact of today's world. It seems as if it appears everywhere and advertisers are always looking for new ways to get their message across and attract the attention of target audiences. Indeed, industries have grown up around advertising in various media, including new, specialized media, as well as around new ways of advertising, product placement, and so on.

It has long been known that subways and trains present an advertising opportunity. A subway or train is filled with passengers and they often go through tunnels not visible to the outside world. This means that signage in such tunnels presents a rather unique advertising opportunity. A sign in such a location will have a captive audience as riders pass by it. Locating signage in such tunnels will not generate the same types of concerns that often arise in connection with billboards and other signage in open, public places, which often is subject to regulation. However, there are some difficulties with such signage, such as access for changing the signs and lamps, size and the need to catch the attention of riders, especially when they are passing through a tunnel at a relatively high rate of speed.

One idea that has been around for quite some overcomes the smearing effect of a speeding subway train to create the appearance of a stationary picture, which can be a still image or animated, by use of a series of fixed still frames. This can be analogized to motion pictures in the pre-digital age when motion pictures relied upon a series of still photographs on film projected in rapid succession onto a screen by a movie projector, which, with persistence of vision, produced the effect of moving images. However, unlike motion pictures, the screen in a subway tunnel is not fixed. It is, instead the movement of the train past a series of pictures fixed on the subway wall that is roughly analogous to the movie projector by providing the rapid succession of images to the viewer. This means that the series of pictures must be correctly positioned on the subway wall, and lighted, and if animated, the pictures must be created to take into account the speed of the train relative to the fixed images to display the animated commercial at the correct speed. This, in turn, has created many challenges, and a great many inventors have sought to address such challenges for a long time.

For example, in U.S. Pat. No. 2,299,731, issued in 1942, a display system for moving vehicles is described which provides for illumination of a series of displays by successive brilliant flashes of light of extremely short duration. Roughly thirty years later, stroboscopic systems for display were disclosed in U.S. Pat. Nos. 3,694,062 and 3,951,529 while U.S. Pat. No. 3,704,064 disclosed a flash tube for use in a subway signage animation system. One of the problems with such systems was high cost, and U.S. Pat. No. 4,393,742, issued in 1983, sought to reduce such cost by using a sensor to measure the velocity of a train and then initiate the flash cycle based upon the results of the sensor. Another problem with such systems was the triggering mechanism for illuminating the series of displays, and one invention directed to this problem is U.S. Pat. No. 5,108,171, issued in 1992.

With the dawning of the new millennium, a number of new patents have issued in the art of subway signage. U.S. Pat. No. 6,169,368 discloses the use of a sensor to activate a controller upon the approach of a train to trigger an electronic display mechanism controlled by a computer. U.S. Pat. No. 6,353,468 discloses use of flat screen LED monitors in the display. U.S. Pat. No. 6,466,183 discloses a video display apparatus. U.S. Pat. No. 6,870,596 discloses a subway movie/entertainment medium and news reports indicate that the company which owns this patent, Sidetrack Technologies Inc., has installed its system in a number of subways throughout the world.

Thus, it is clear that there is a need and demand for subway signage systems and this is a medium of advertising that has drawn considerable attention, including commercial attention, over the years.

In U.S. Pat. No. 6,564,486, issued in 2003 to Spodek et al. ("Spodek"), an approach to subway signage is disclosed which is analogous to a zoetrope for use in subway signage systems in an attempt to overcome problems associated with stroboscopic displays, such as timing. Spodek uses a display in which a series of still pictures are viewed through a slitboard mounted between the images and the viewers in a train. The details and math associated with such a display are discussed in rather great detail in Spodek and will not be repeated herein, but simply incorporated herein by reference for use as part of the background to the present invention. The technology of Spodek has been licensed to a company named Submedia that has advertising systems that are now located in some of the world's top media markets, including New York, Washington, D.C., Chicago, Atlanta, Boston, Hong Kong, Tokyo and Mexico City.

The present invention seeks to advance the art of subway signage by advancing the teachings of Spodek through use of novel apparatus and methods that greatly increases the efficiency and ease of use of subway signage systems according to the teachings of the present invention.

SUMMARY OF THE INVENTION

The present invention is generally directed to an apparatus and method for displaying a visual message to a viewer moving along a path of travel past one or more viewing boxes, each containing transparent images illuminated by a substantially vertical reflected light of narrow width relative to the transparent images, the reflected light for more than one image being provided by a single substantially vertical light source located in the viewing box behind the transparent images.

In a first, separate group of aspects of the present invention, the back-lighted images can have the appearance of either a still or moving image and the images can be displayed on a video display (such as an LCD video display). The reflected light is obtained by use of curved reflectors (such as a rod, a tube and a rounded shape stamped in a reflective sheet or reflective film) that may be spaced symmetrically behind the substantially vertical light source. Baffles can be used so only one bright reflection appears behind each transparent image and to prevent secondary reflections, and a baffle located between the substantially vertical light source (such as a fluorescent lamp) and two transparent images can be an opaque black baffle.

Accordingly, it is a primary object of the present invention to provide improved back-lighted images for viewers moving rapidly past such back-lighted images that rely upon a single vertical light source to provide multiple reflected line scans of transparent images located between the light source reflections and viewers.

This and further objects and advantages will be apparent to those skilled in the art in connection with the drawings and the detailed description of the preferred embodiment set forth below.

BRIEF DESCRIPTION OF THE DRAWINGS

FIG. 18 shows that the reflected-light pitch RLP is uniform between two tubular reflectors associated with one light source, and also between tubular reflectors associated with adjacent light sources.

FIG. 24*a* shows an alternate technique to simplify assembly is shown by attaching black velvet VEL to a strip of velvet-backing material VBM which has been fitted with snap fasteners SF, used to attach that strip to the back metal wall of the light box LB.

FIGS. 29 & 30 show the inner walls IW of the extrusions which serve the same function as the internal-reflection barrier IRB in FIGS. 18 and 20-23.

DESCRIPTION OF THE INVENTION

Figure 1:
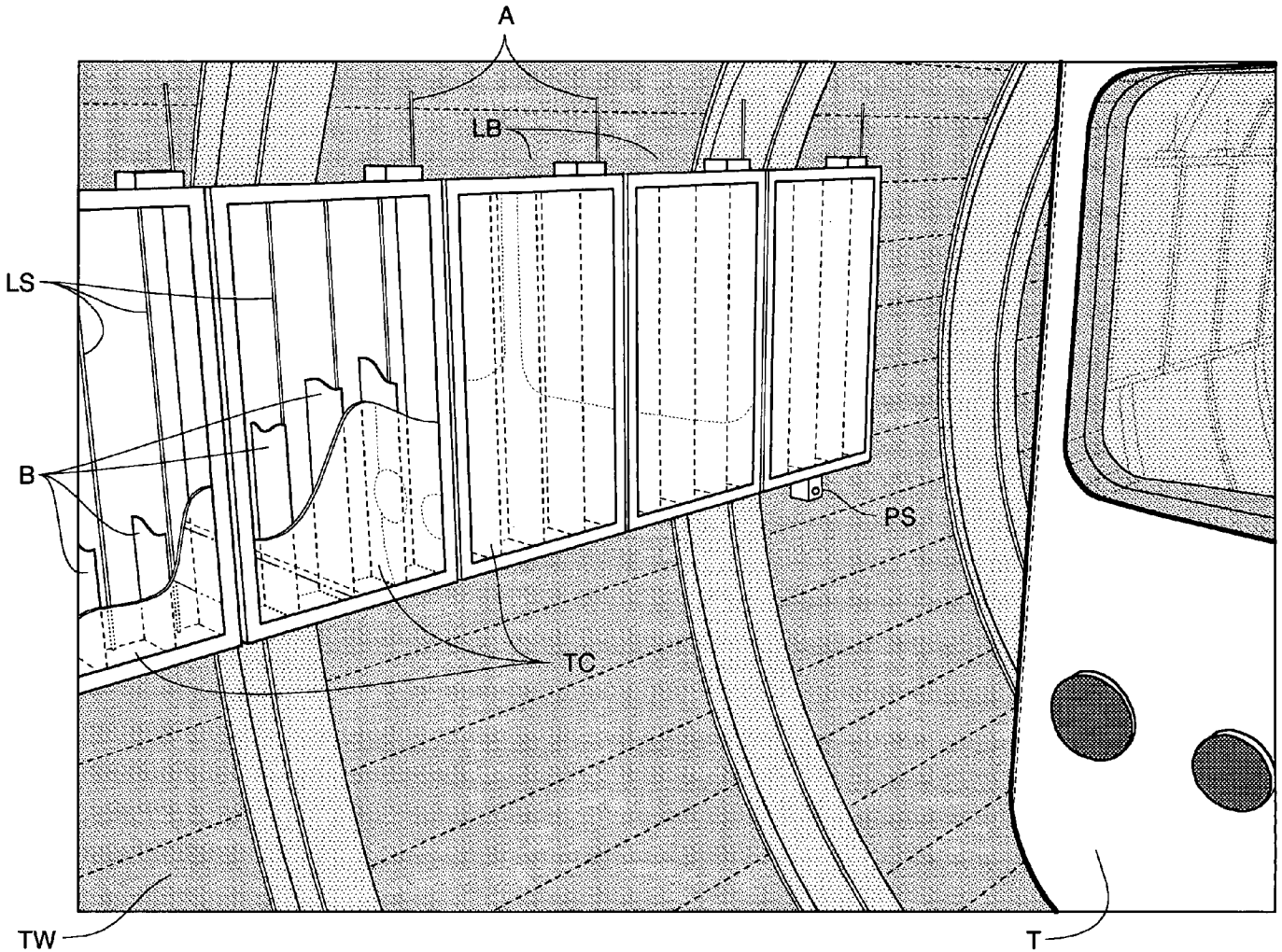
FIG. 1 depicts a series of viewing boxes according to the present invention arranged in series in a subway tunnel.
Figure 2:
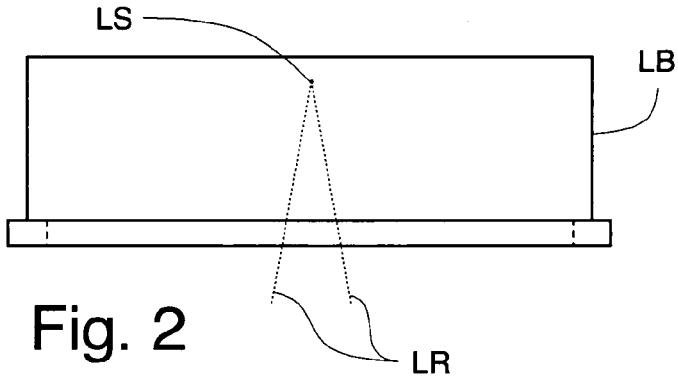
FIG. 2 is a top view depiction of a viewing box according to the present invention showing the horizontal field of illumination of a single vertical light source.
Figure 3:
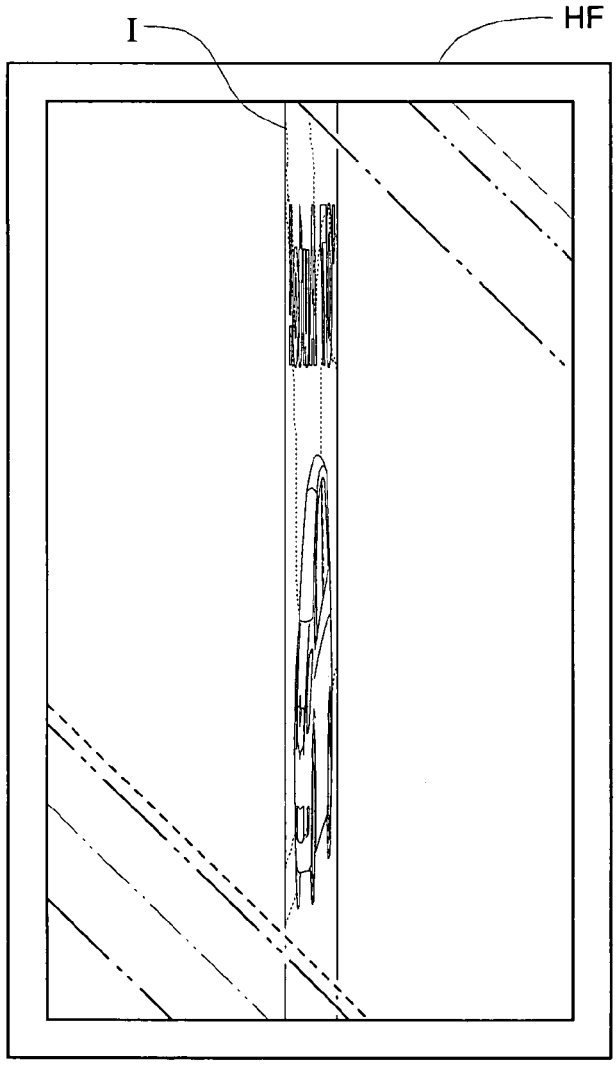
FIG. 3 is a frontal view illustrating the viewing box of FIG. 2.
Figure 4:
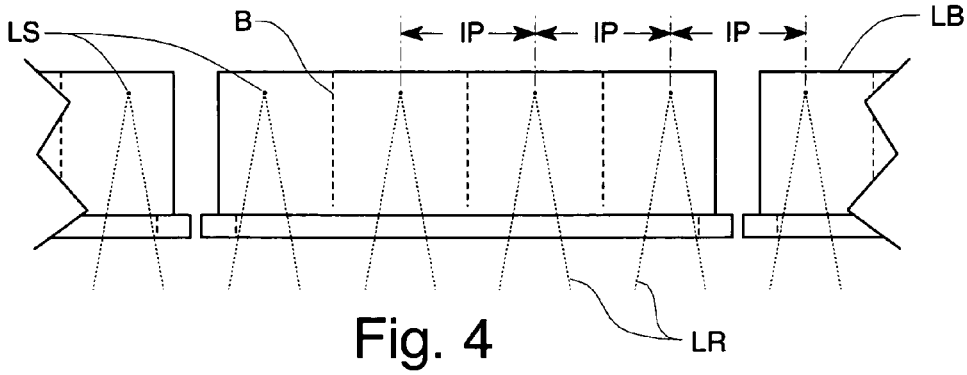
FIG. 4 is a top view depiction of a series of viewing boxes according to the present invention, each of the viewing boxes having multiple vertical light sources and transparent images (not shown) which can be separated by an optional baffle.
Figure 5:
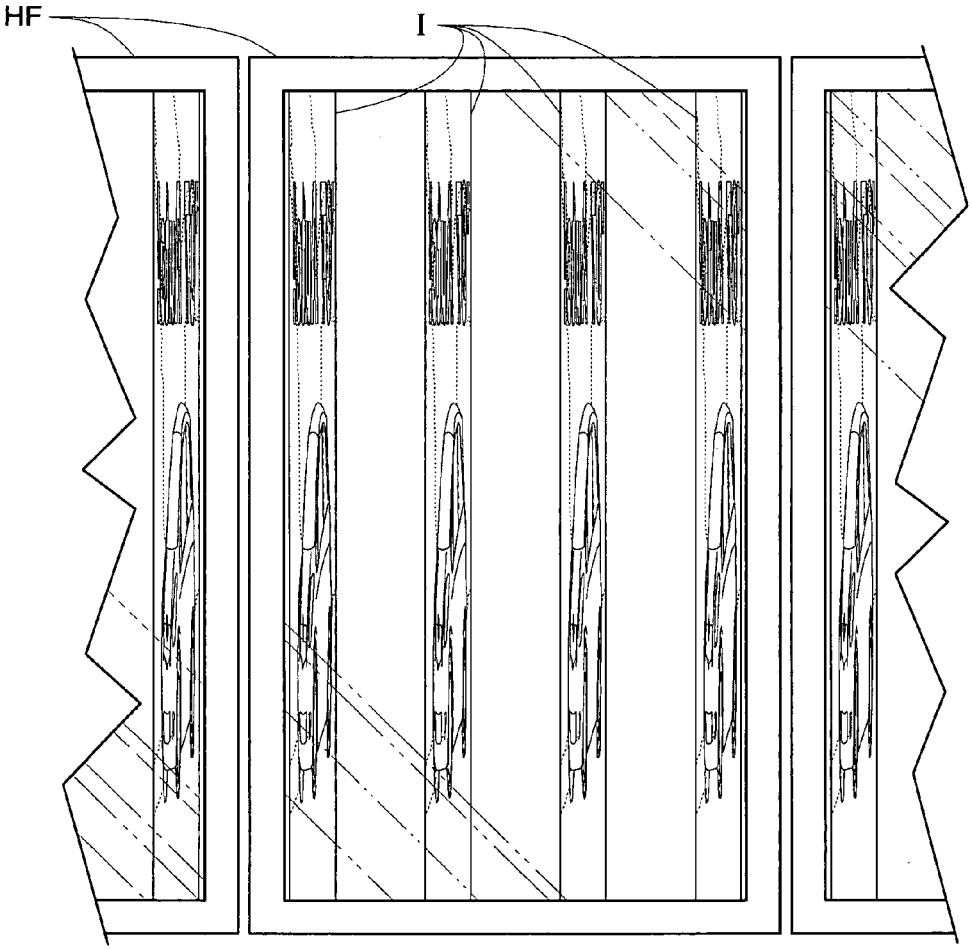
FIG. 5 is a frontal view illustrating the series of viewing boxes of FIG. 4 without baffles.
Figure 6:
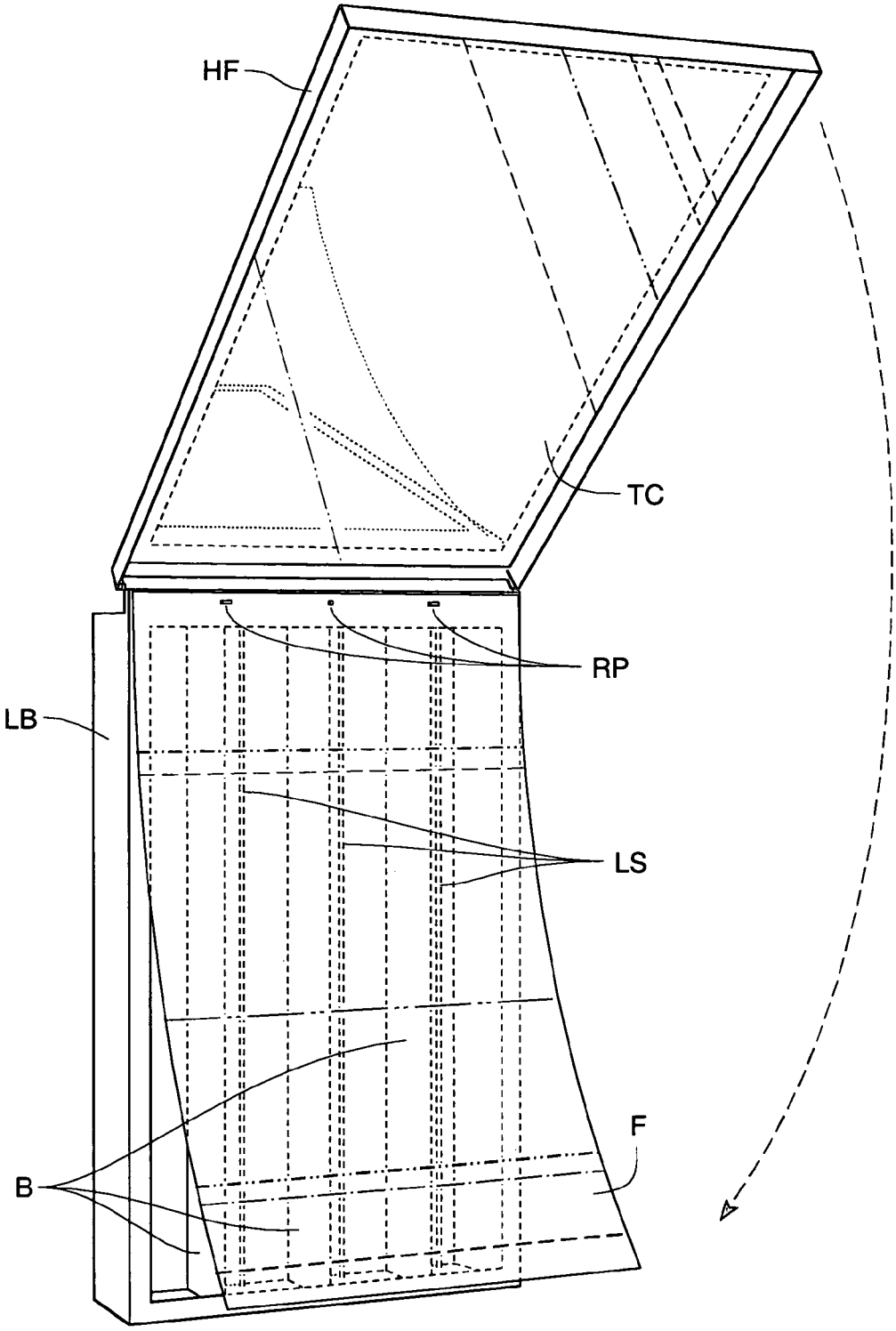
FIG. 6 is an illustrative drawing of a viewing box according to the present invention illustrating the viewing box being opened so as to install a film image.
Figure 7:
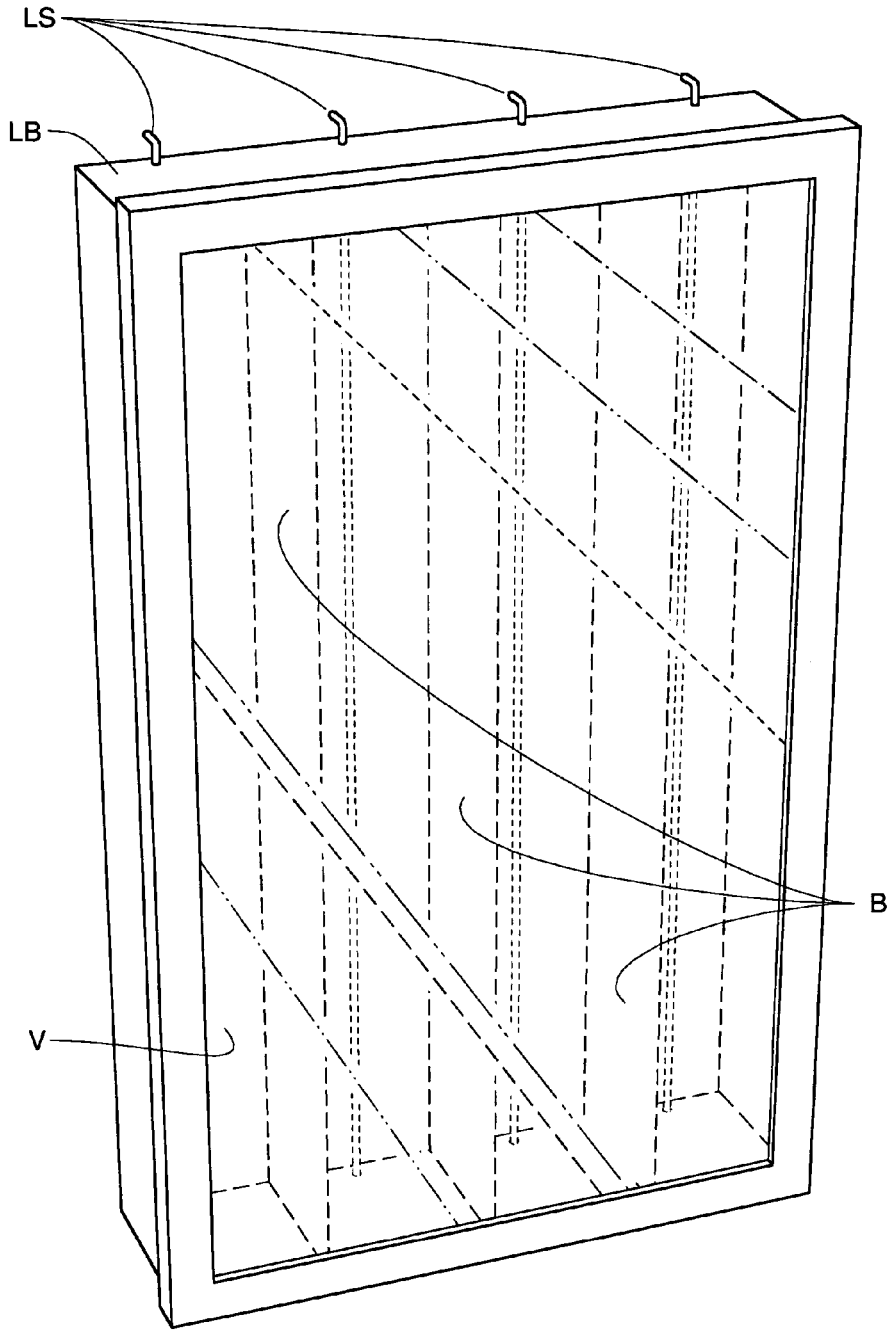
FIG. 7 is illustrative of a viewing box according to the present invention using either a film image of FIG. 6 or a video screen, without its typical backlight and omni-directional diffuser.
Figure 8:
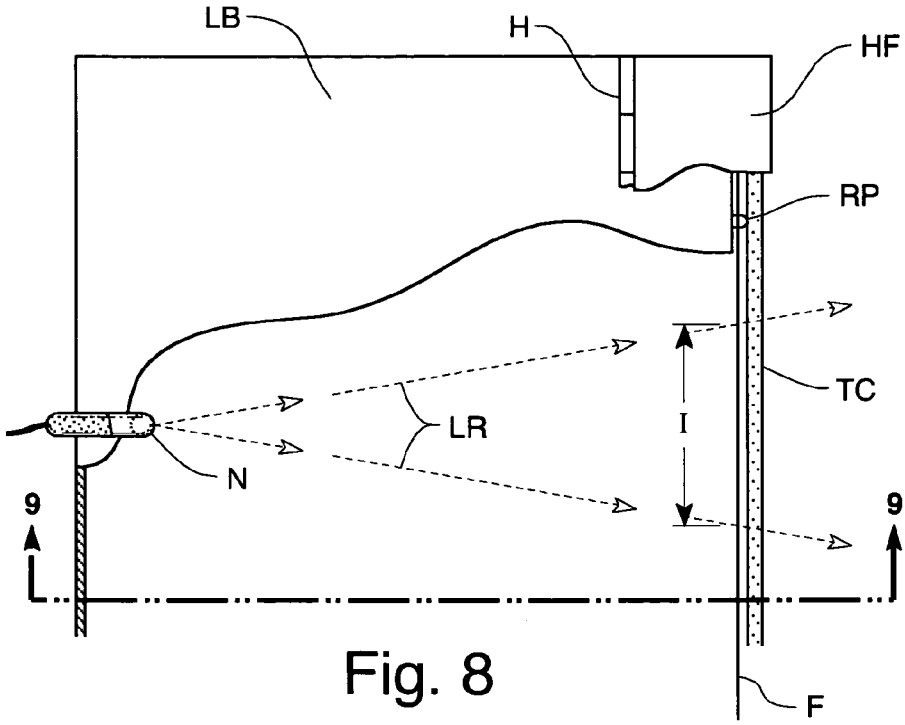
FIG. 8 is an illustrative cross-sectional top view depiction of a viewing box according to the present invention using a neon tube as a substantially vertical light source illuminating image I on film F with the field of illumination illustrated by light rays LR at the outer boundaries.
Figure 9:
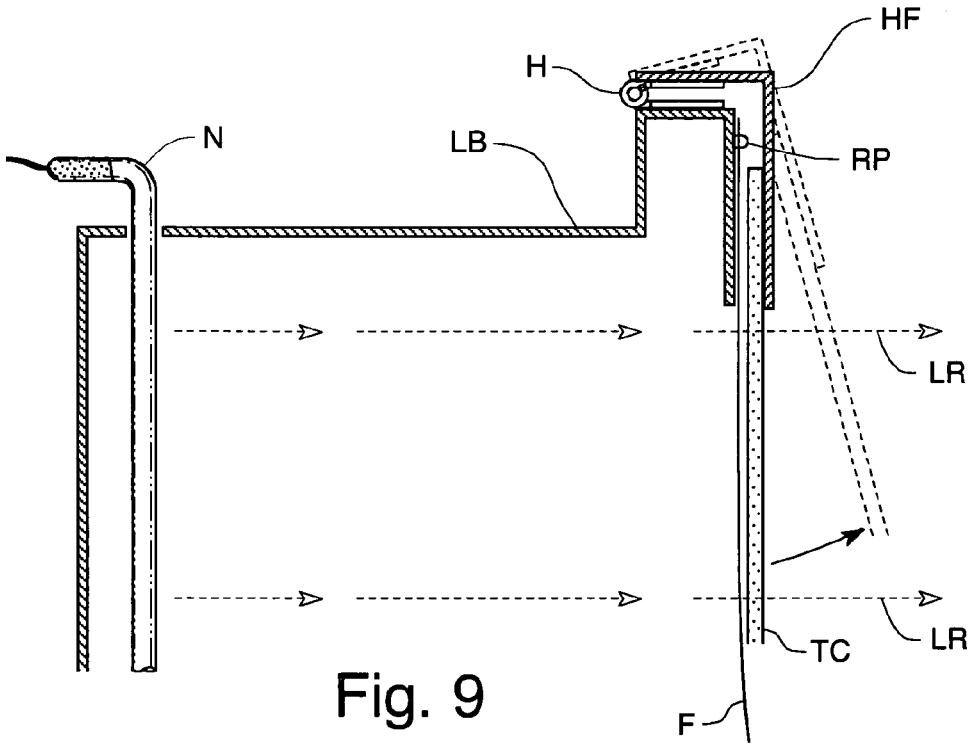
FIG. 9 is an illustrative cross-sectional side view taken along line 9-9 of FIG. 8 that also illustrates, in phantom, opening of hinged frame HF.
Figure 10:
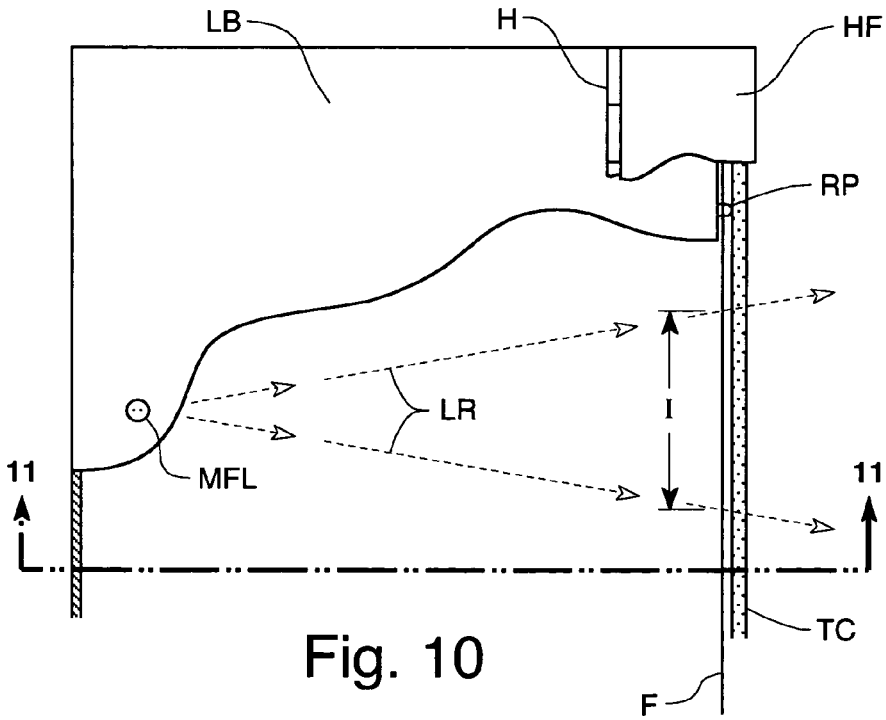
FIGS. 10 and 11 are similar to FIGS. 8 and 9 except that the substantially vertical light source is a miniature fluorescent lamp and hinged frame HF is not illustrated as opening in phantom lines.
Figure 11:
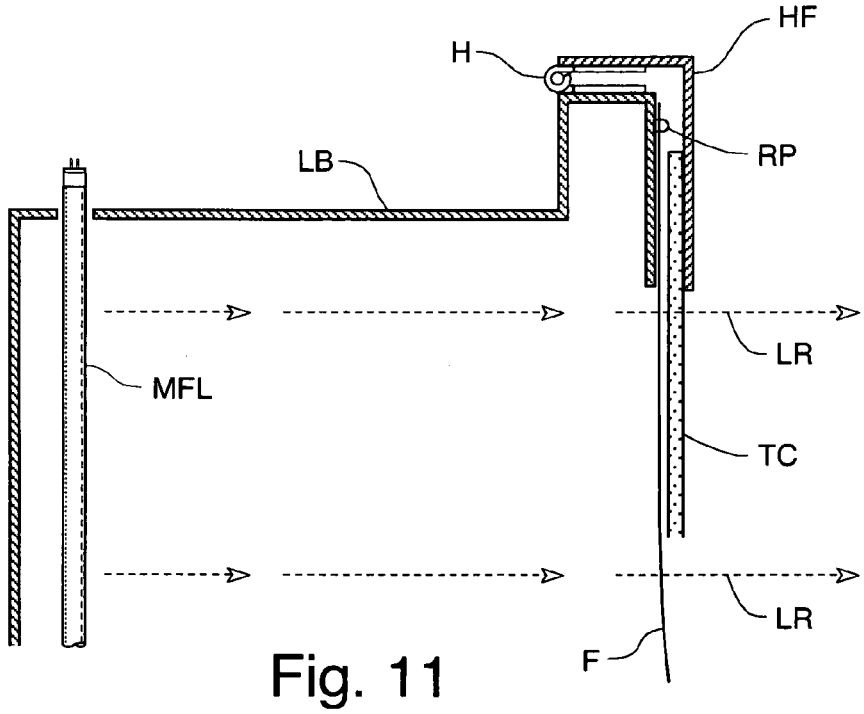
Figure 12:
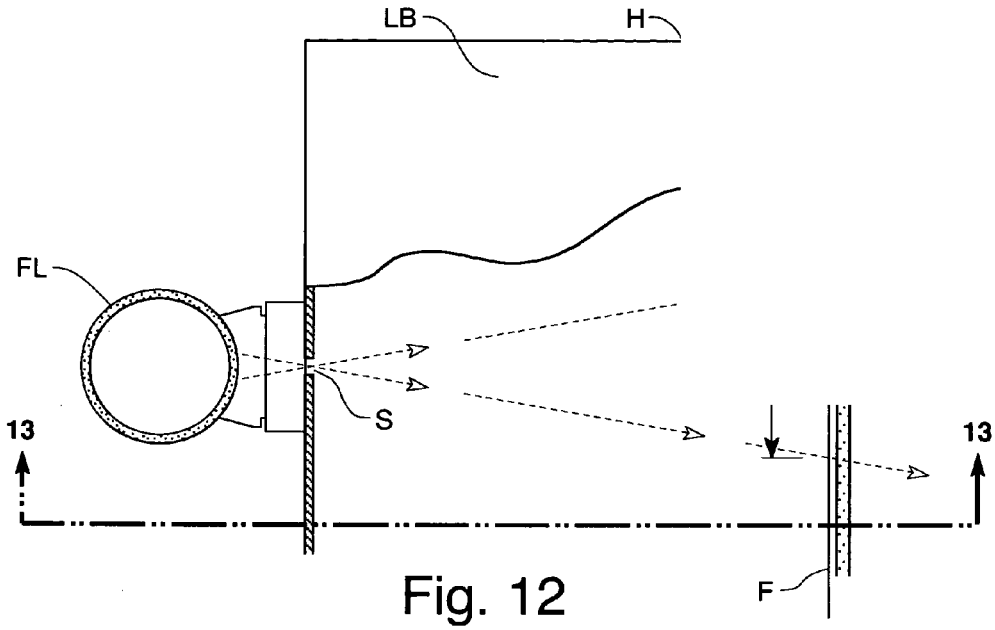
FIGS. 12 and 13 illustrate an alternative embodiment to the embodiment depicted in FIGS. 10 and 11 in which a conventional fluorescent lamp is located behind a wall having a slit S so as to create a substantially vertical light source of narrow width relative to the transparent image I on film F.
Figure 13:
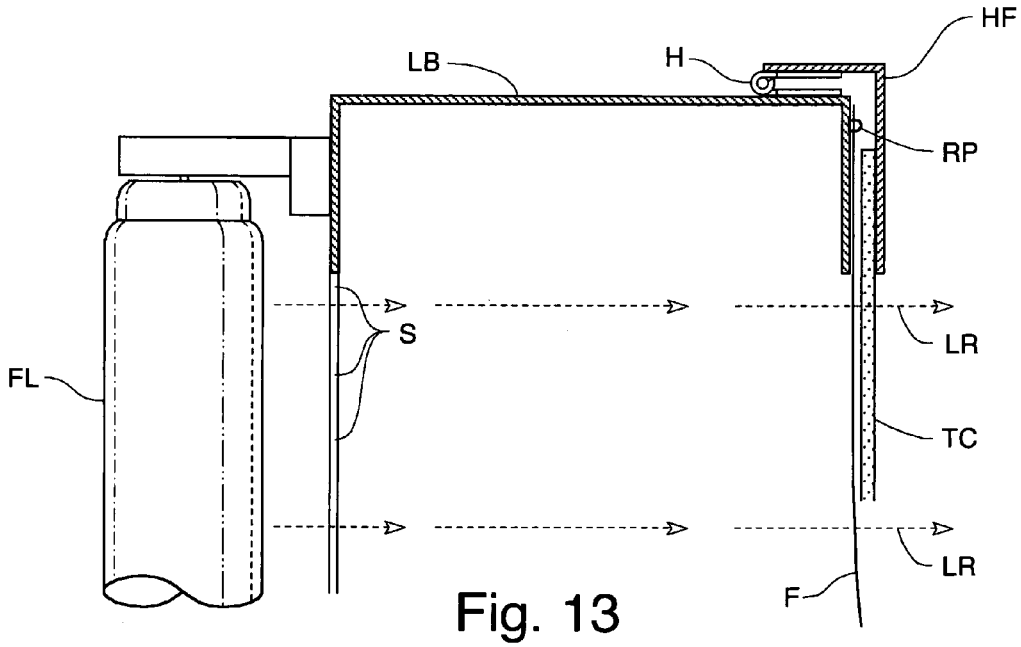
Figure 14:
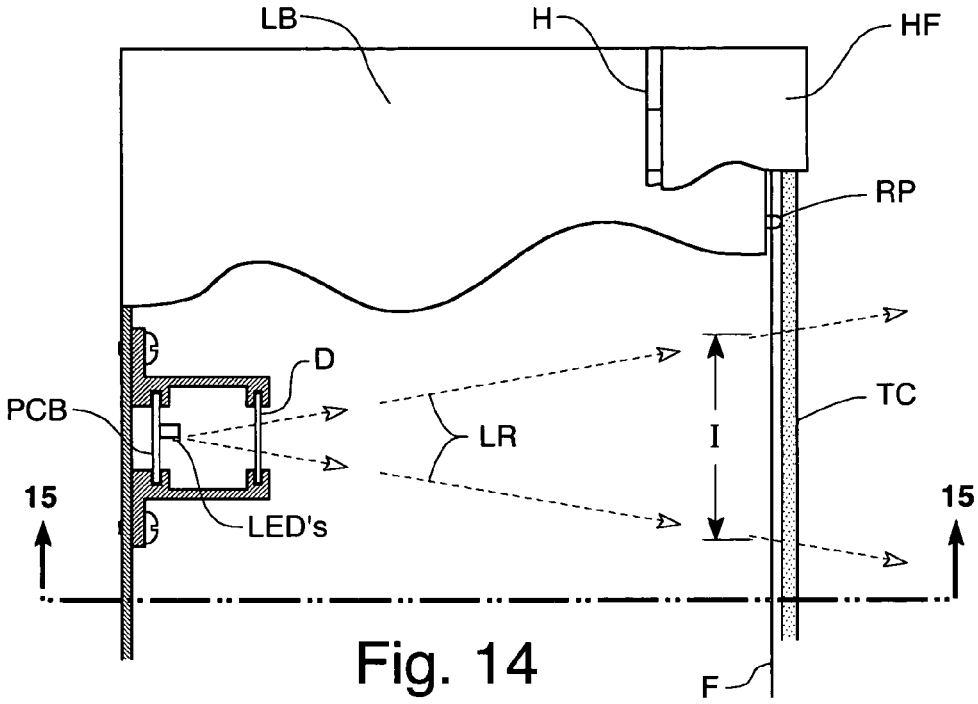
FIG. 14 is similar to FIG. 10 except that the substantially vertical light source is a column of light emitting diodes (LEDs) with a vertical diffuser D.
Figure 15:
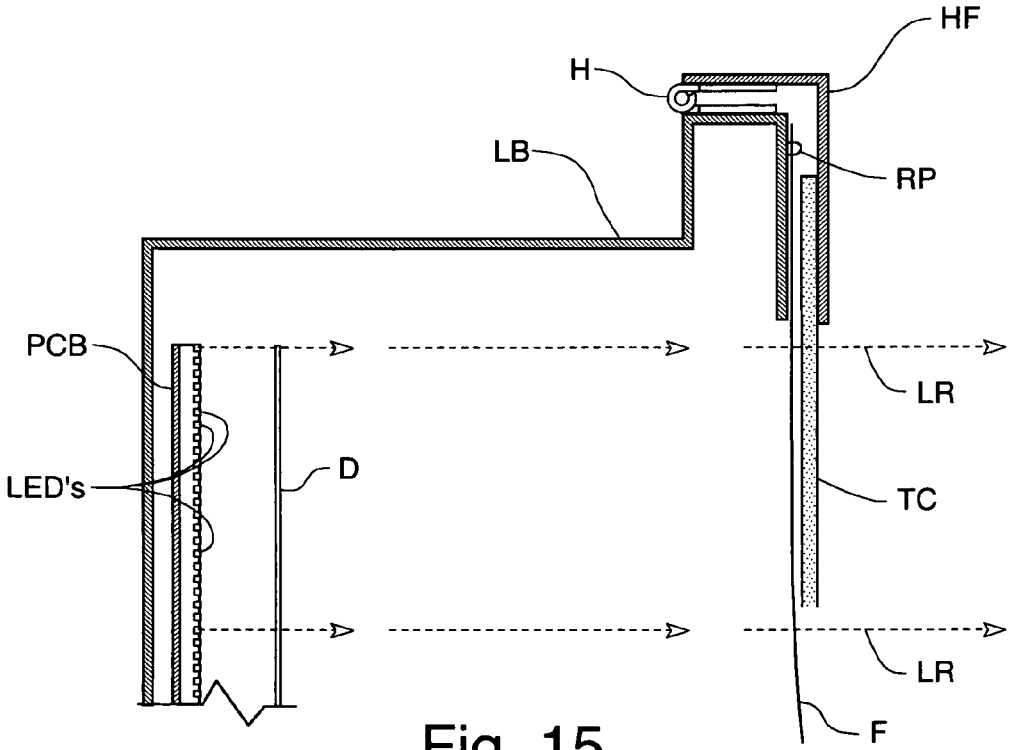
FIG. 15 is similar to FIG. 11, based upon the embodiment shown in FIG. 14, except that portions of the structure illustrated in FIG. 16 have been removed.
Figure 16:
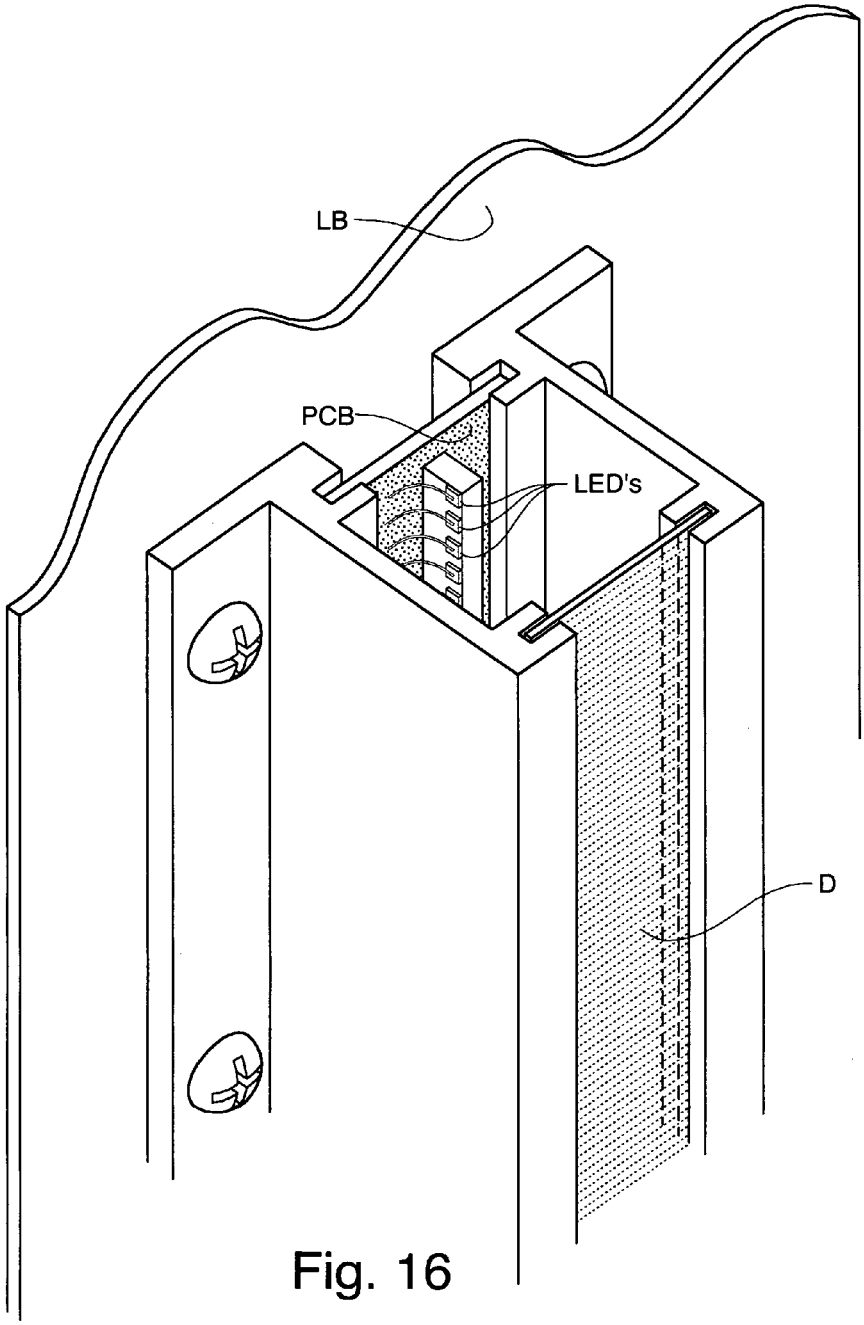
FIG. 16 is a partial side depiction of a column of LEDs shown in FIG. 14.
Figure 17:
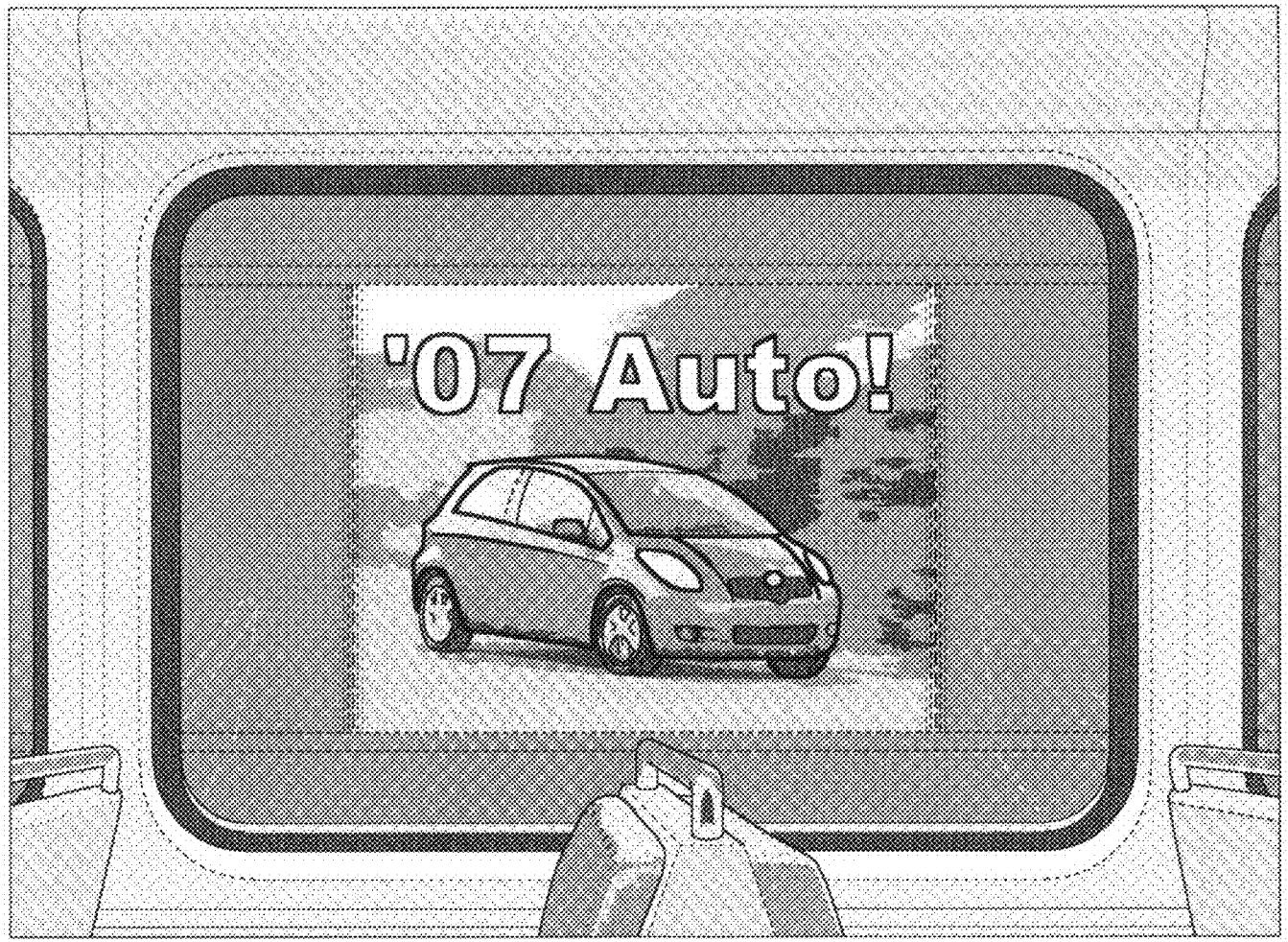
FIG. 17 is the image perceived by a viewer as a train moves rapidly past multiple back lighted images according to the present invention. The vertical sides appear smeared due to the motion of the train past the light boxes.
Figure 18:
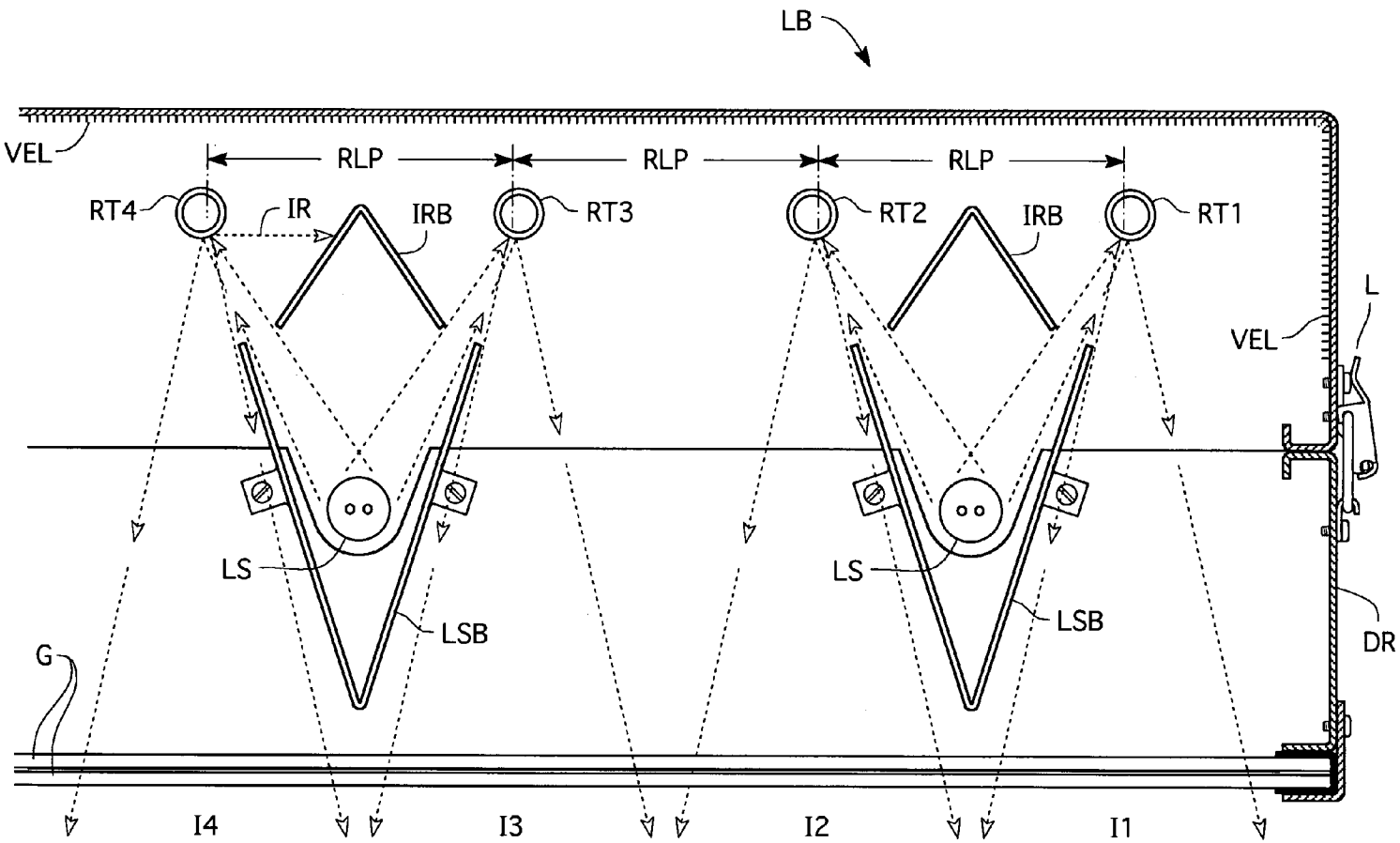
FIG. 18 is a top view showing two light sources, each reflecting off of two tubular reflectors. Further.
Figure 19:
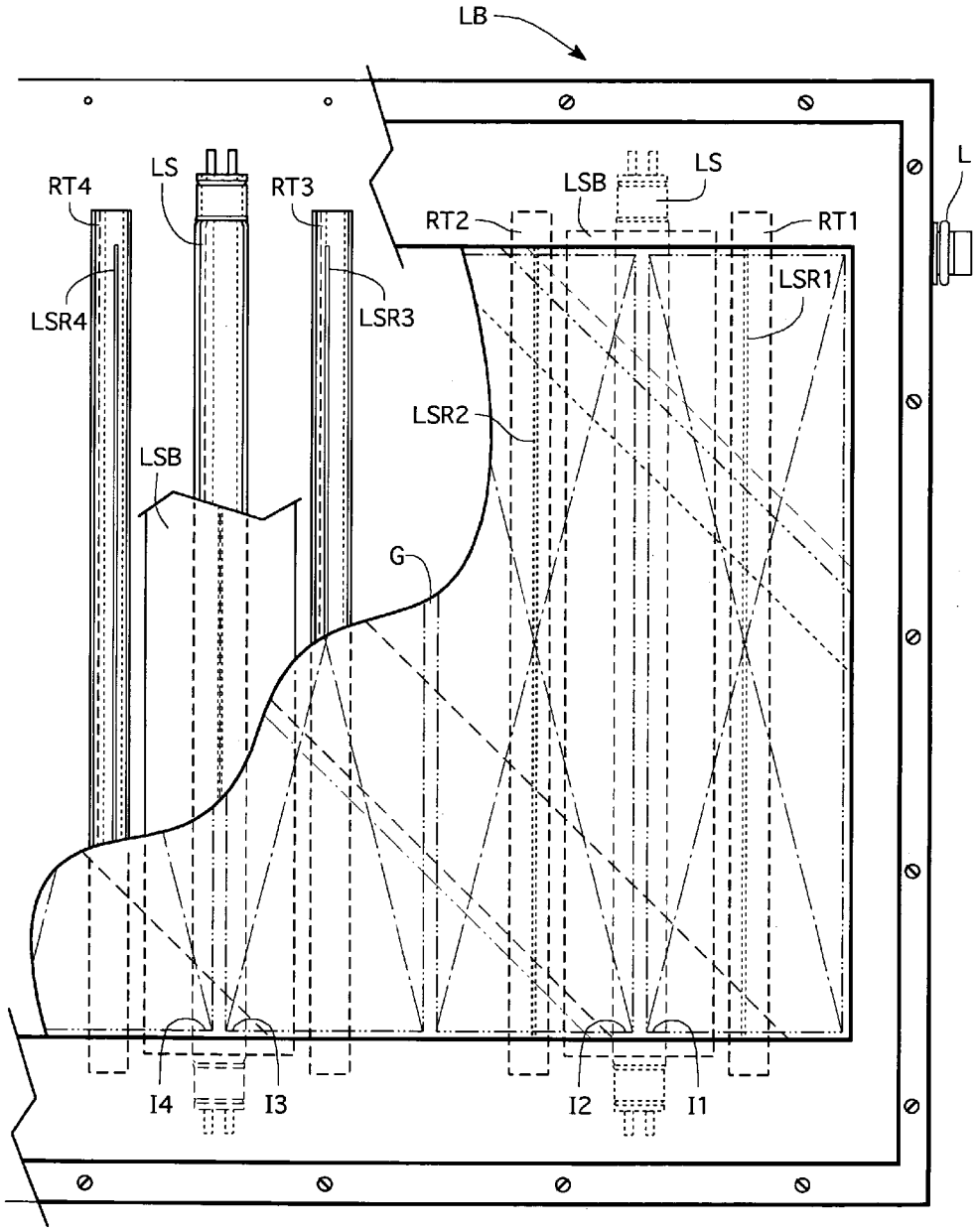
FIG. 19 is a partial cut away front view of a light box showing two light sources LS, each covered with a light-source baffle LSB, and reflective tubes RT showing the light-source reflection LSR.
Figure 20:
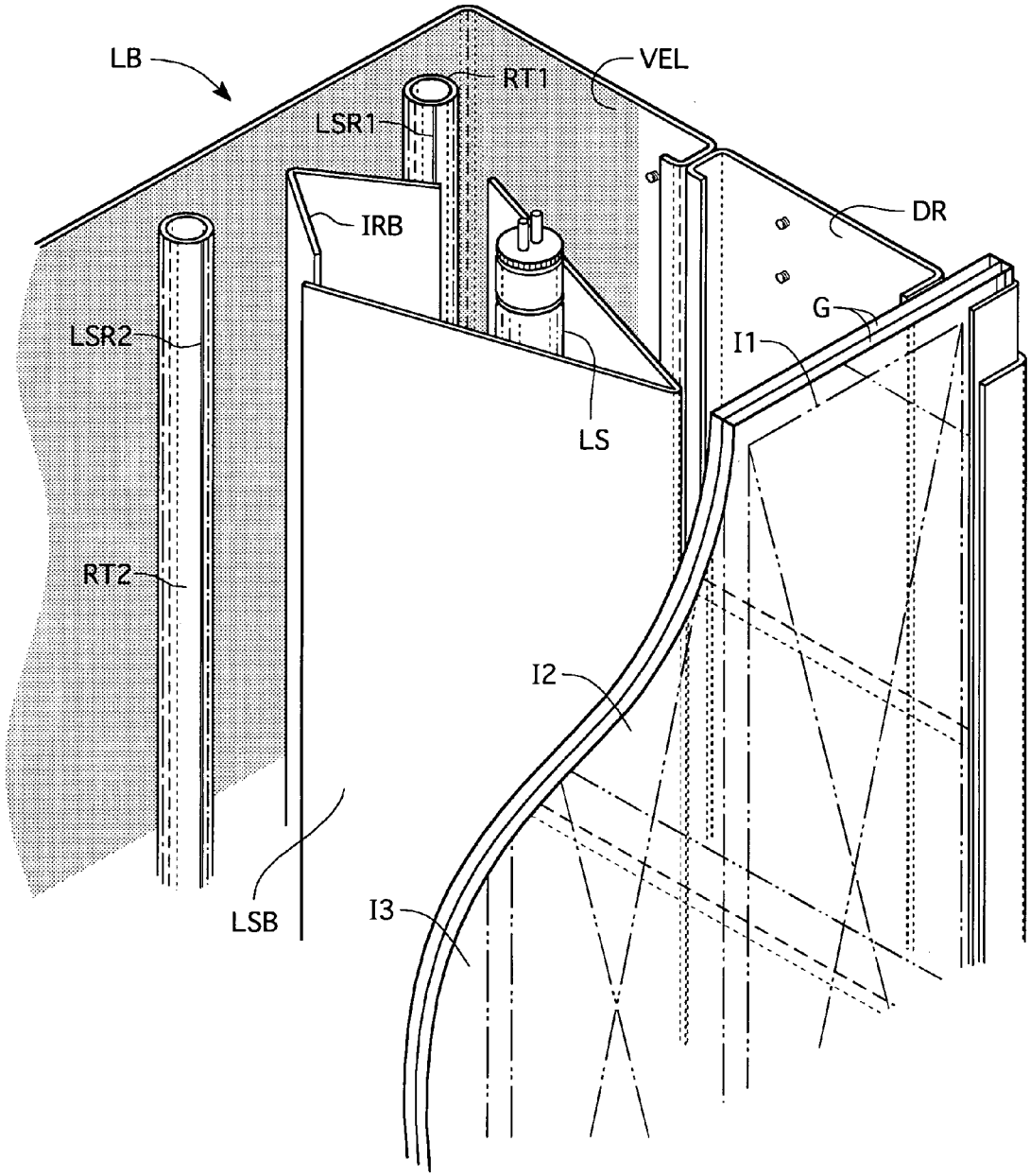
FIG. 20 is a perspective cut away of the light box showing one light source LS, its light-source baffle LSB, internal-reflection barrier IRB, reflective tubes RT with light-source reflections LSR, and front glass G image panel with images I1, I2 and I3.
Figure 21:
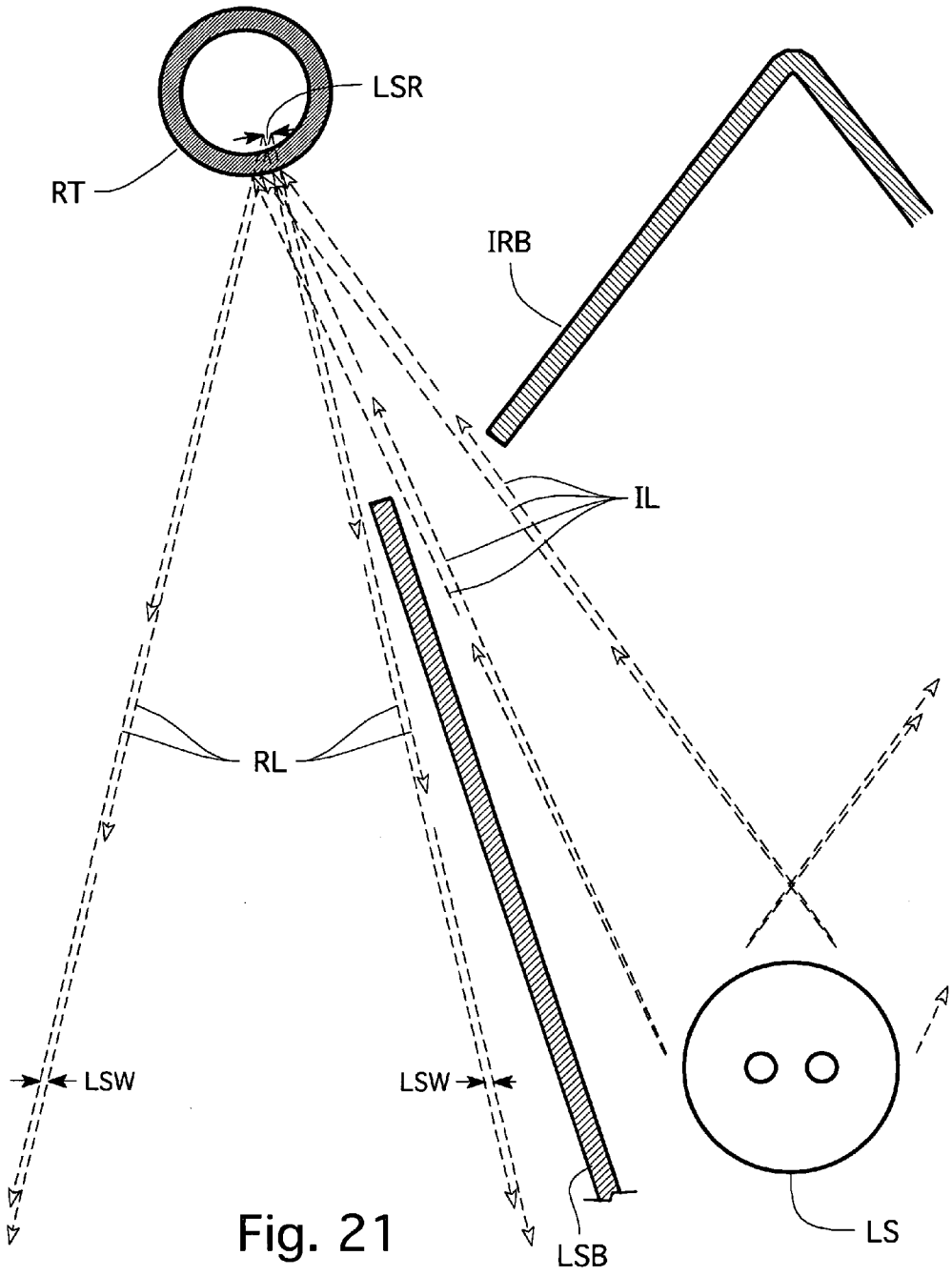
FIG. 21 shows a detailed ray trace from the fluorescent lamp light source LS with incident light IL onto reflective tube RT, with reflected light RL directed toward the film or video image I.
Figure 23:
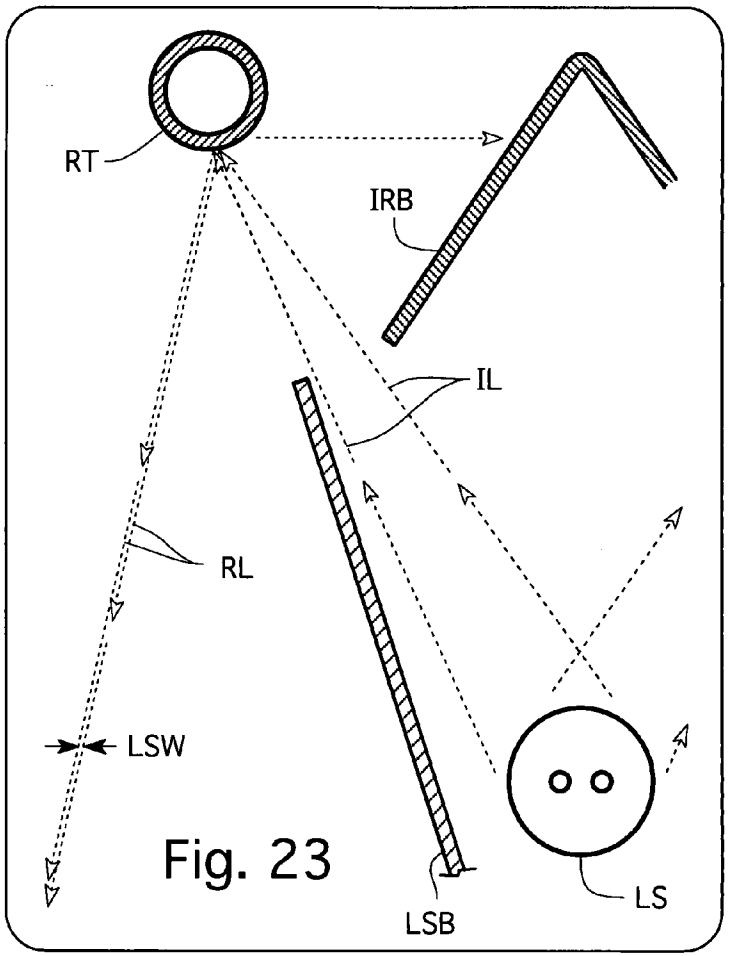
FIGS. 22 and 23 show the location of the reflection on the reflective tube RT for the extreme right and left positions, respectively.
Figure 22:
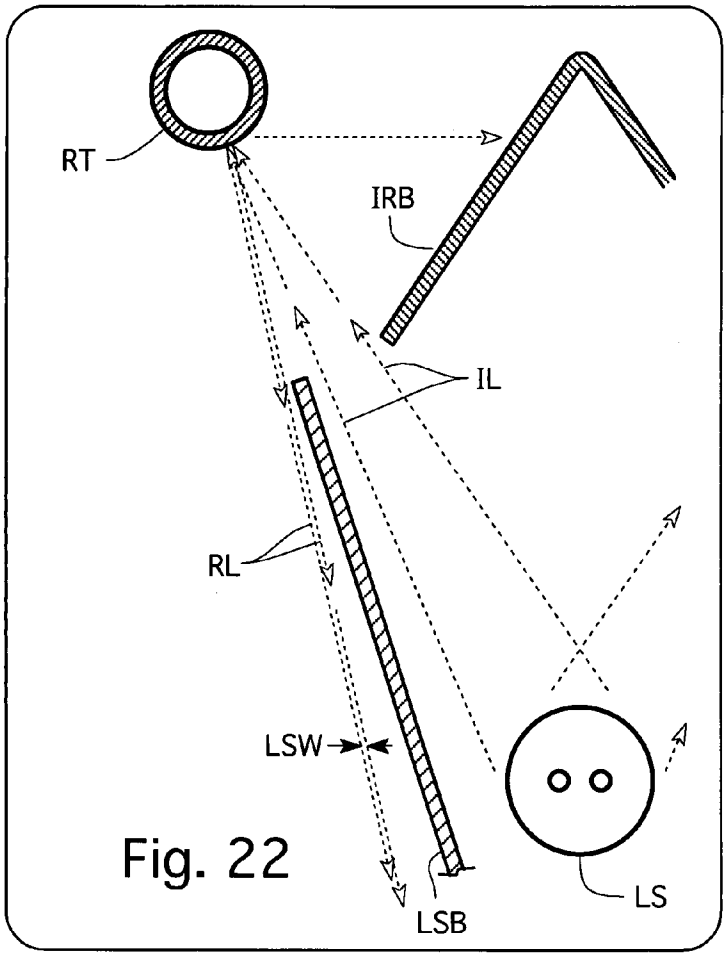
Figures 24, 24A:
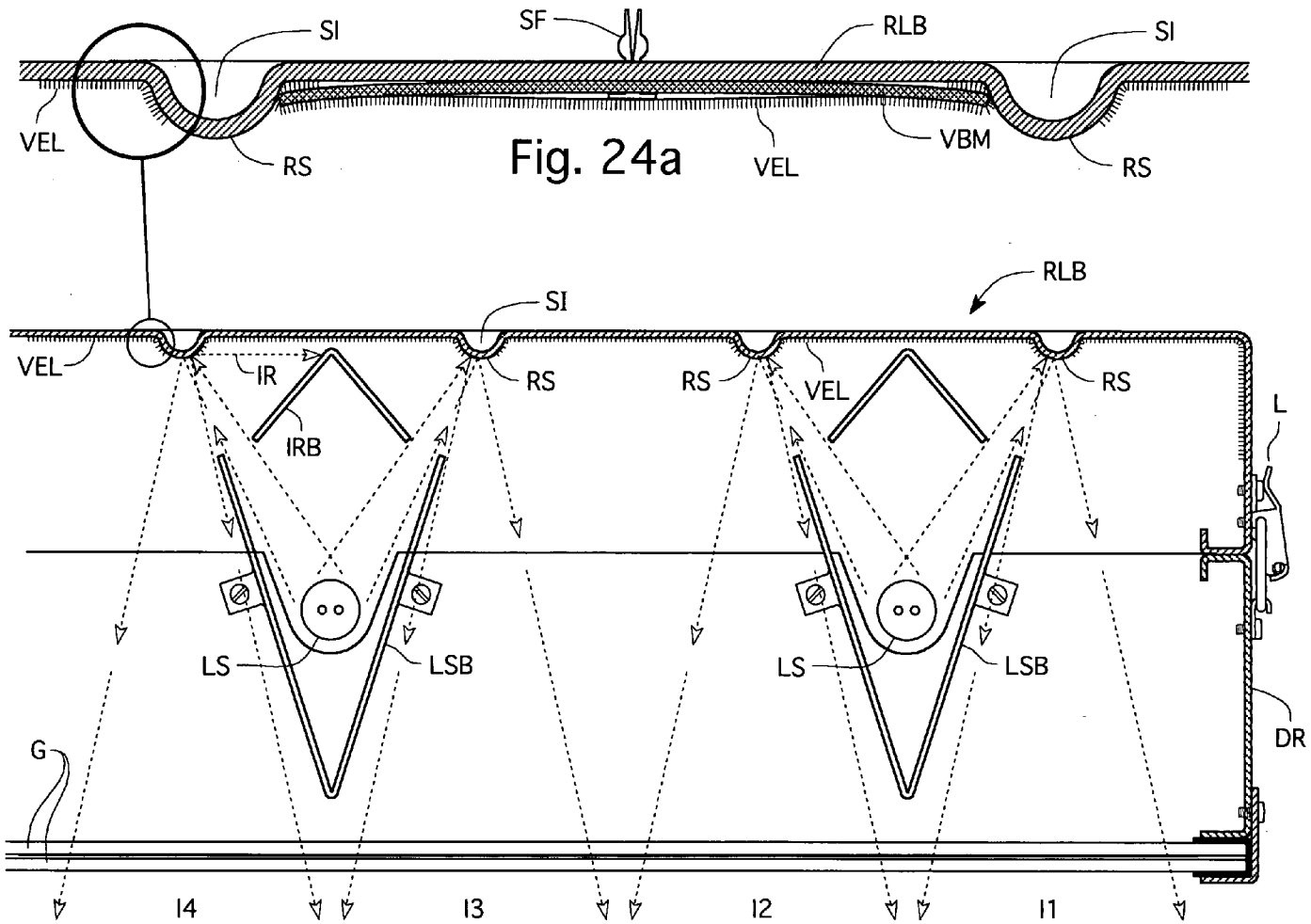
FIG. 24*a* is an enlarged section through a light box showing at left a magnified view of the adhesive-backed velvet VEL attached to the back wall.
Figure 25:
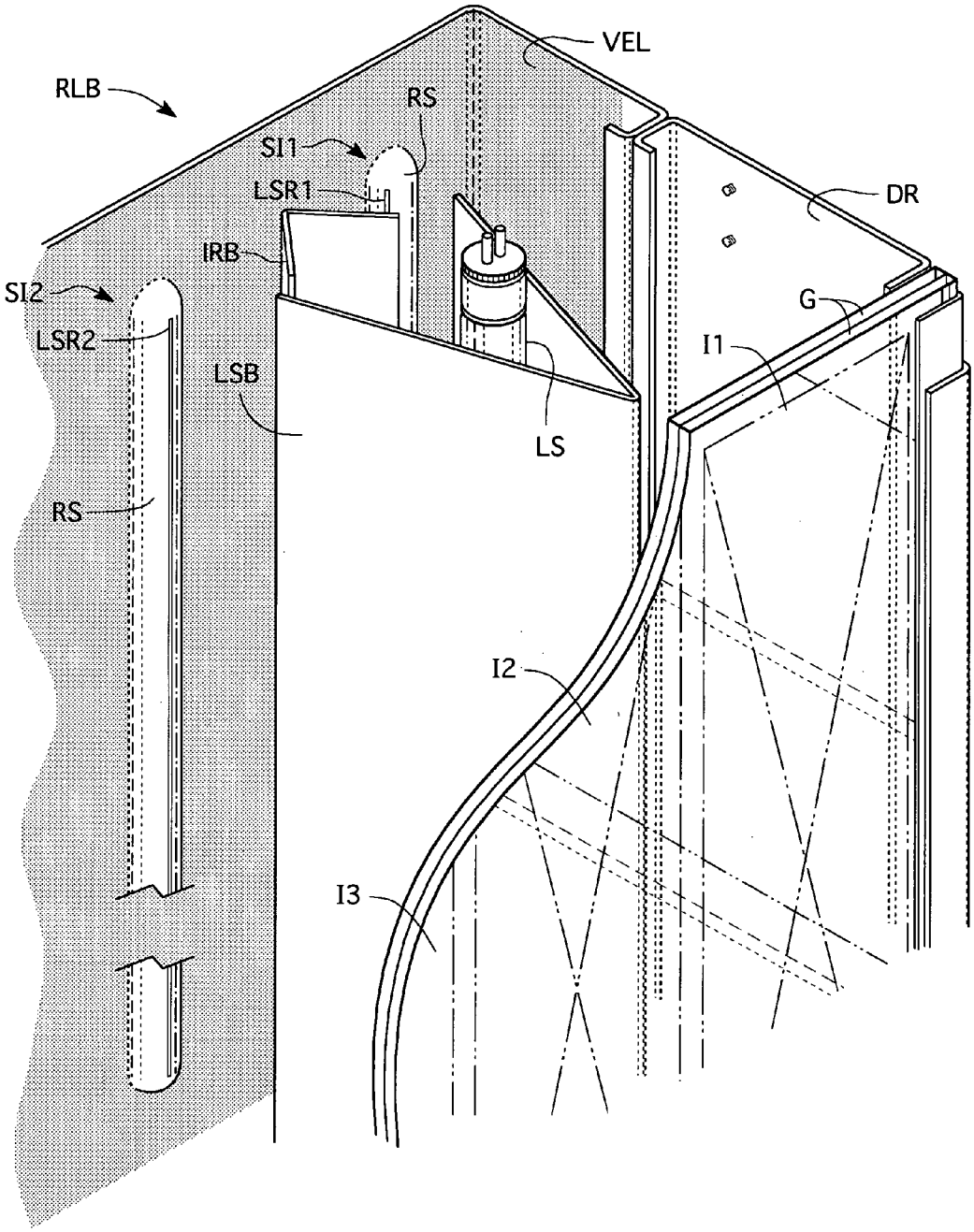
FIG. 25 is a perspective view of the cut away light box showing the light source LS and light-source baffle LSB illuminating cylindrical stamped indentations SI on the back wall of the light box, and black velvet VEL to absorb unwanted stray light.
Figure 26:
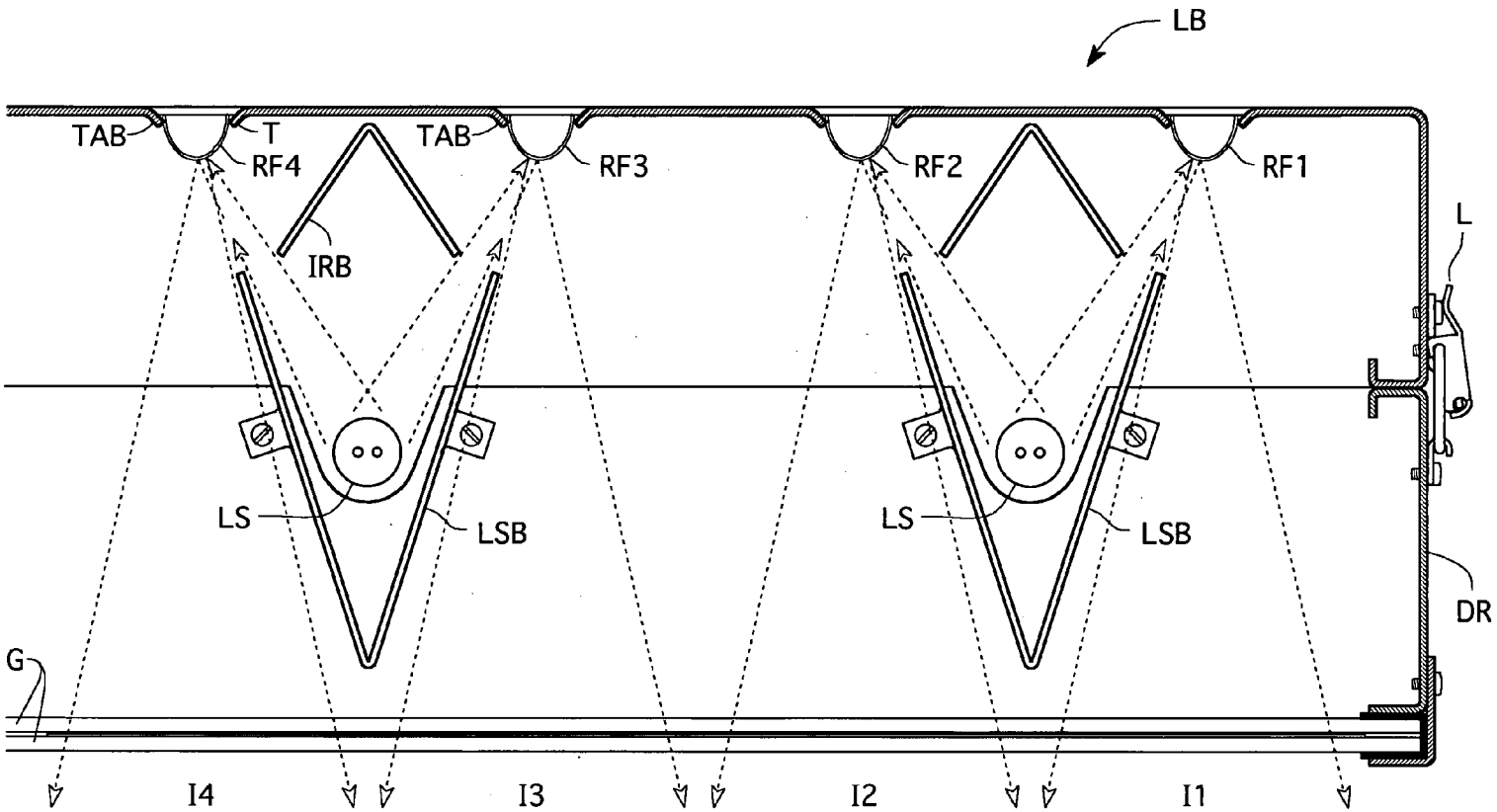
FIGS. 26 and 27 show an alternate light box LB made with small tabs TAB stamped into the back of the metal light box LB to which reflective film RF is attached.
Figure 27:
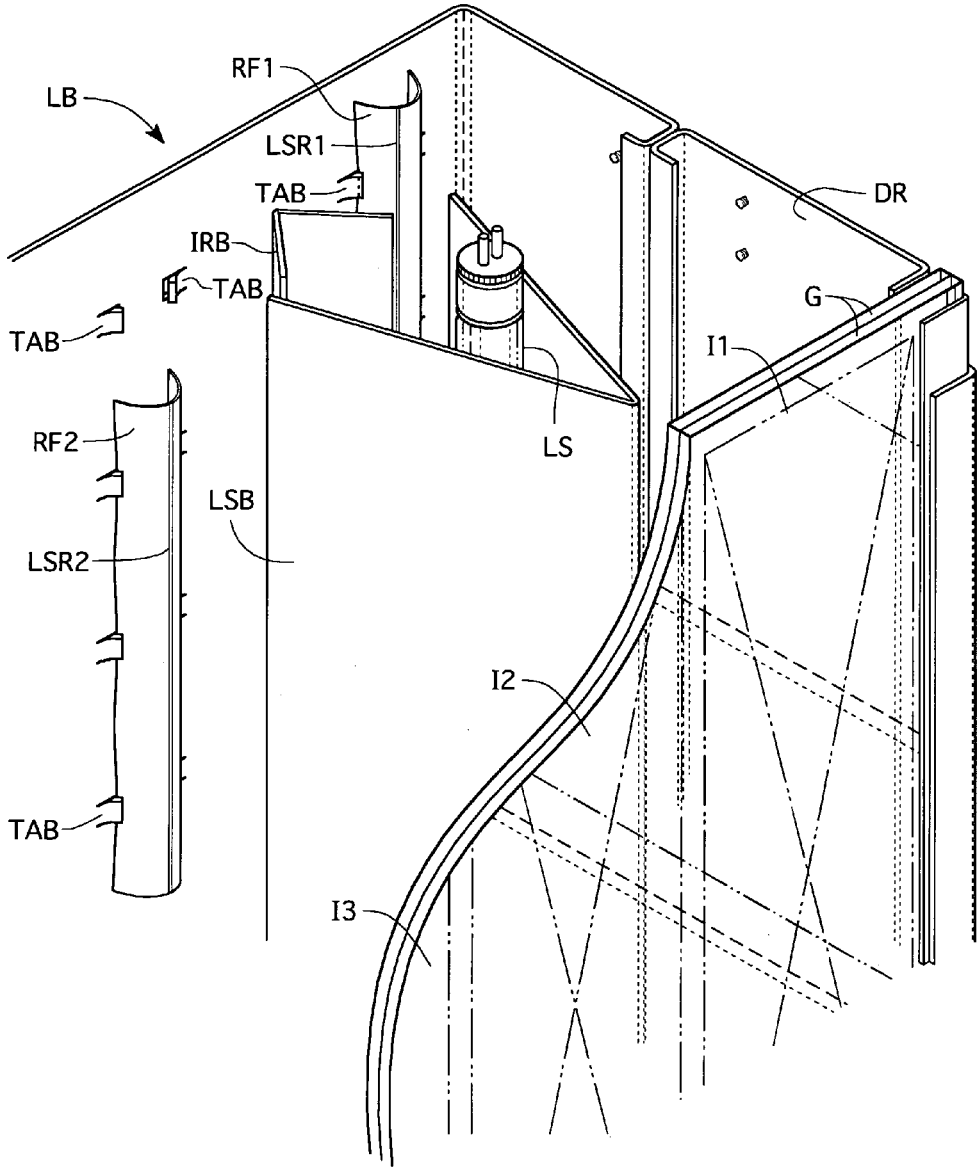
Figure 28:
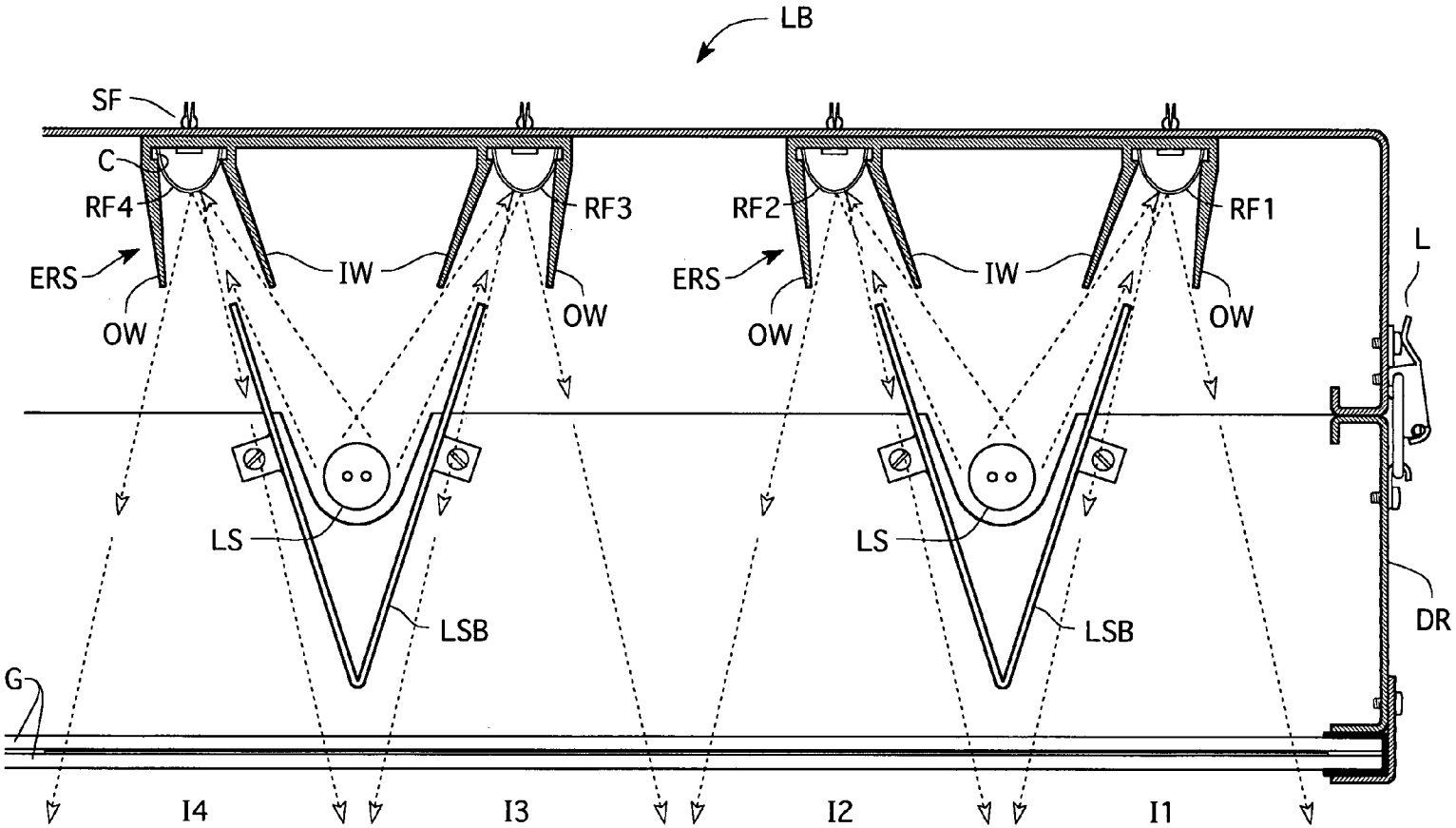
FIGS. 28-30 show extruded reflector supports ERS, made preferably of black plastic, or aluminum with black anodized finish or painted with flat black paint.
Figure 29:
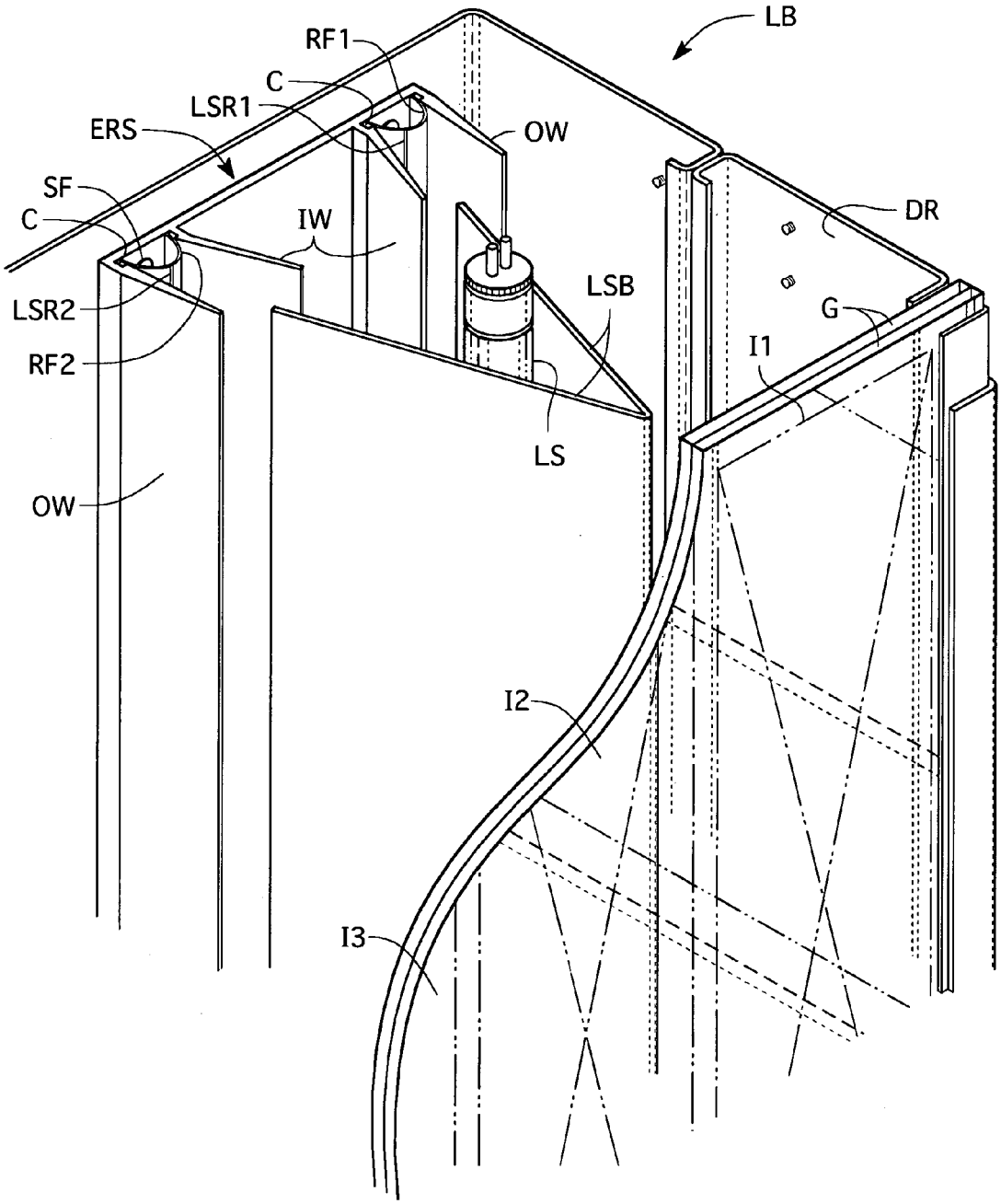
Figure 30:
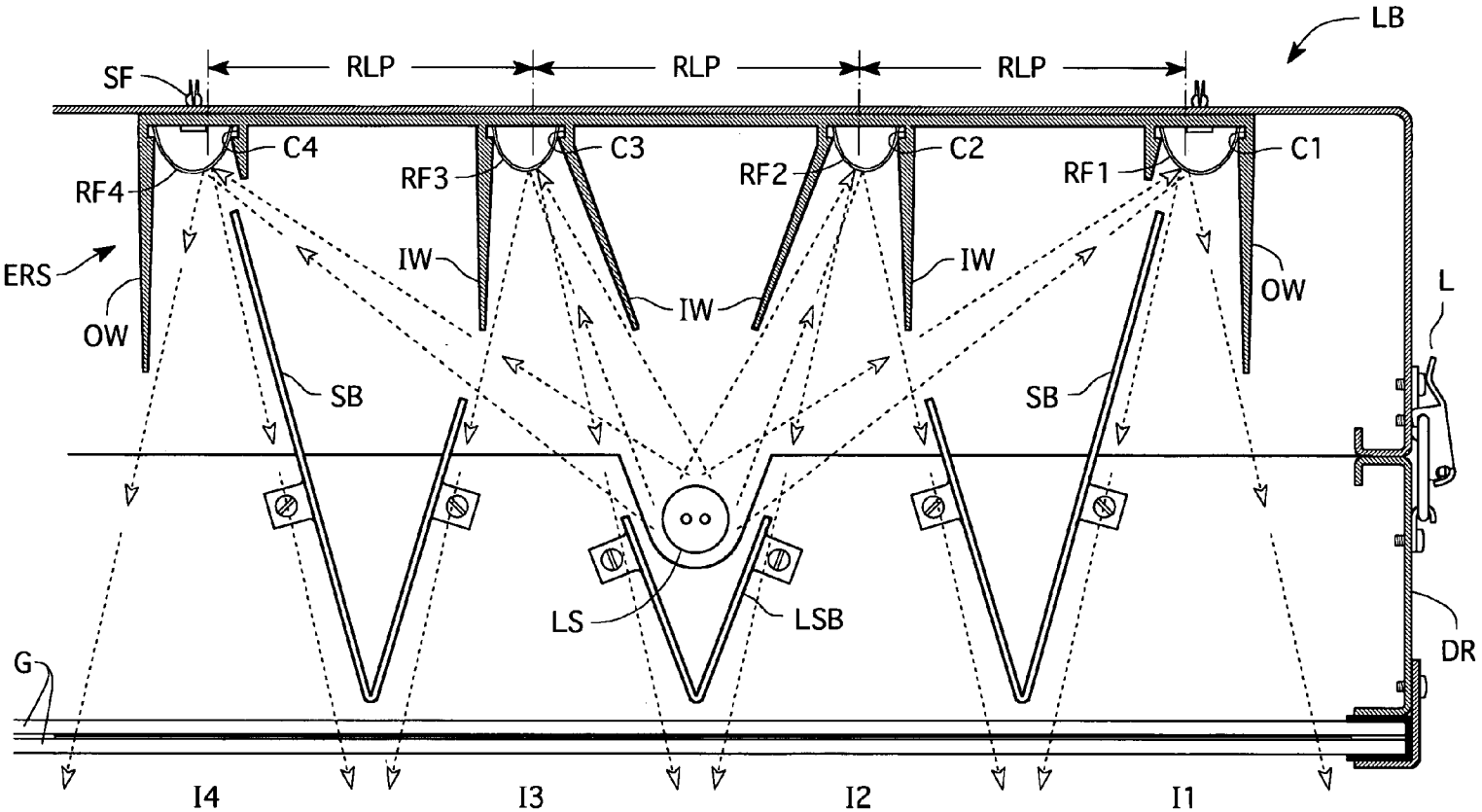
Figure 31:
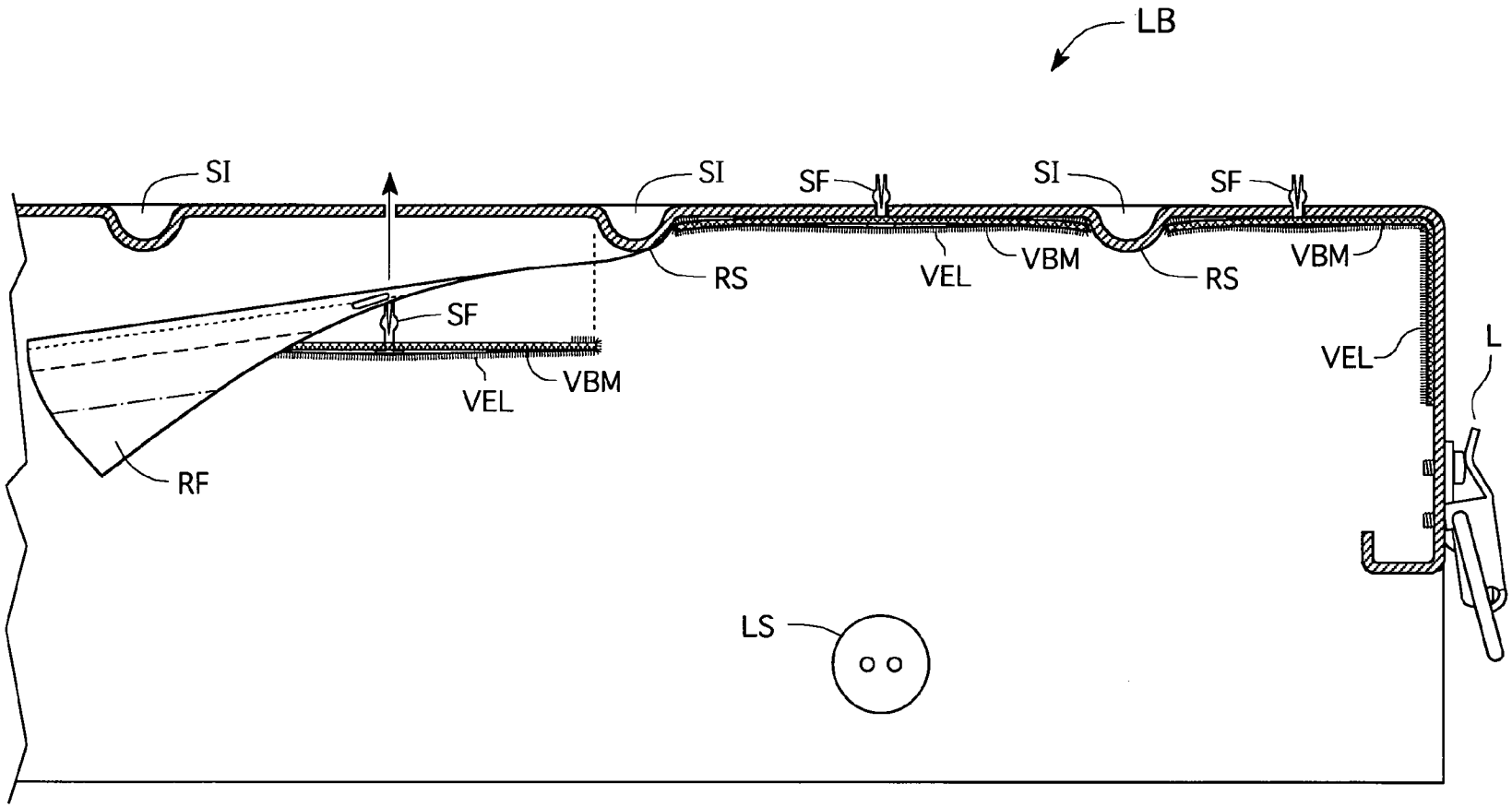
FIG. 31 shows an alternate construction in which reflective film RF is "wall papered" or attached to the interior wall of the box.
Figure 32:
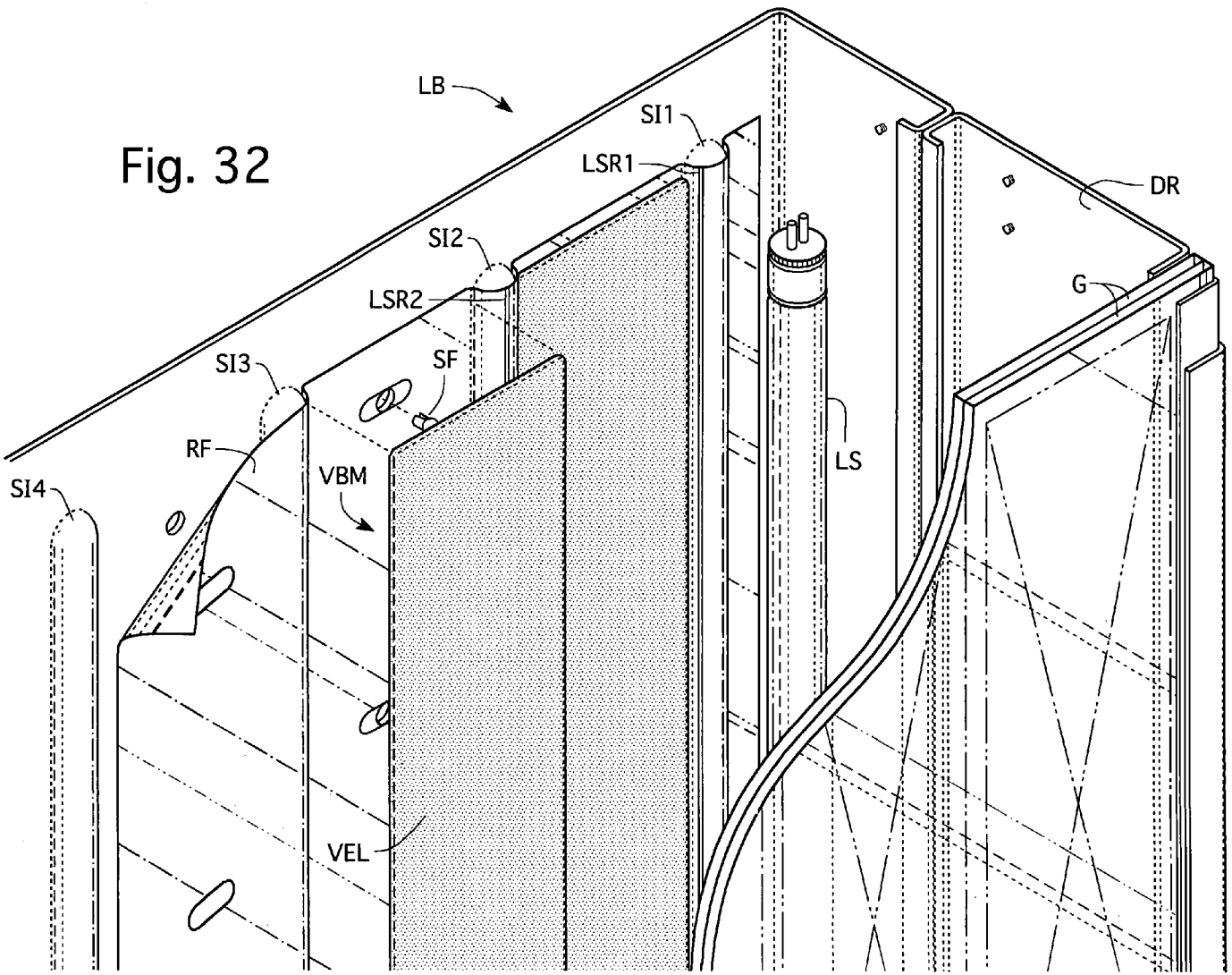
FIG. 32 is a perspective view showing the assembly of the reflective film RF being trapped by black-velvet covered backing material which forces the reflective film to wrap around, and therefore conform to, the curvature of the stamped indentations SI.

As this application is an improvement over the invention that I disclosed in my earlier application of which this is a continuation-in-part application, I will first describe the original invention for context and then describe the improvement thereto. However, to aid the reader in understanding my disclosures, the following is a glossary of the elements identified in the Figures:

A Antenna, FIG. 1
B Baffles, FIGS. 1, 4, 6 &7
C Channel, FIGS. 28-30
D Diffuser, FIGS. 14-16
DR Door, FIGS. 18, 20, 24-30, 32
ERS Extruded Reflector Support, FIGS. 28-30
F Film, FIGS. 6, 8-15, FL Fluorescent Lamp, FIGS. 12 & 13
G Glass, FIGS. 18-20, 24-30, 32
H Hinge, FIGS. 8, 9, 10, 11, 12, 13, 14, 15
HF Hinged Frame, FIGS. 3, 5, 6, 8, 9, 10, 11, 12, 13, 14, 15
I Image, FIGS. 3, 5, 8, 10, 12, 14, 18-20, 22-28
IL Incident Light, FIG. 21-23
IP Image Pitch, FIG. 4
IR Internal-Reflection, FIGS. 18, 22-24
IRB Internal-Reflection Barrier (or "Baffle"), FIGS. 18 & 20-27
IW Inner Wall, FIGS. 28-30
L Latch, FIGS. 18, 19, 24, 26, 28 & 30-31
LB Light Box, FIGS. 1, 2, 4, 6-16, 18-20, 26-32
LED's LED's, FIGS. 14-16
LR Light Ray, FIGS. 2, 4, 8-15
LS Light Source, FIGS. 1, 2, 4, 6, 7 & 18-30
LSB Light-Source Baffle, FIGS. 18-32
LSR Light-Source Reflection, FIGS. 19-21, 25, 27, 29 and 32
LSW Light-Source Width, FIGS. 21-23
MFL Miniature Fluorescent Lamp, FIGS. 10 & 11
N Neon tube, FIGS. 8 & 9
OW Outer Wall, FIGS. 28-30
PCB Printed Circuit Board, FIGS. 14-16
PS Proximity Sensor, FIG. 1
RF Reflective Film (aluminized Mylar™), FIGS. 26-32
RLB Reflective Light Box, FIGS. 24 & 25
RL Reflected Light, FIG. 21-23
RLP Reflected Light Pitch, FIGS. 18 & 30
RP Registration Pins, FIGS. 6, 8, 9, 12-15
RS Reflective Surface, FIGS. 24 & 25
RT Reflective Tubes 18-23
S Slit, FIG. 12
SB Side Baffle, FIG. 30
SF Snap Fastener, FIGS. 7*a*, 28-32
SI Stamped Indentation, FIGS. 24-25, 31 & 32
T Train, FIG. 1
TAB Tab, FIGS. 26 & 27
TC Transparent Cover, FIGS. 1, 6, 8, 9-15
TW Tunnel Wall, FIG. 1
V Video Display, FIG. 7
VEL Velvet, FIGS. 18, 20, 24, 24*a*, 25, 31 & 32
VBM Velvet-Backing Material, FIGS. 24*a*, 31 & 32

My original invention provides a lighted subway system that is much more energy efficient, and thus less costly, than prior lighted subway systems. The display of the present invention simulates the experience of a train rider who is viewing the scene out of the train window, passing distant landscapes, mountains, landscapes, trees, buildings etc. In this setting, the scene looks real and natural, as is the case. Even when the train might pass a tall fence or pass through a wooden covered bridge with sides of vertical slats with narrow slits between the boards, the train rider still sees the scene as the train rushes past the slits between the boards, although a darker image because the slits occupy a small portion of the pitch distance from board to board. Example: if the boards are turned vertically and placed on 6 inch centers however have a 1/16-inch wide gap, the brightness is reduced to 0.0625/6=1%. If the train is traveling at an adequate speed, the passing slits (or boards) will blur and will not appear to be in motion; however, the distant scene will appear normally but attenuated to 1% brightness.

Using the principle of a Zoetrope, viewing an image through a rapidly passing slit, it is possible to simulate the experience of the train rider by providing slits in the foreground through which lighted images are displayed behind the slit. In accordance with simple geometry and proportions, when the depth of the light box is reduced, the width of the image must be reduced in proportion. The width of the image behind the slit is such that from the train rider's viewing distance, the image width is compressed so that the width of the perceived image is in proportion to the height of the image, for example when displaying a TV commercial. Depending on viewing distance, in order to provide the appropriate width, the actual image must be horizontally compressed approximately 6:1 to 10:1.

When the subway train is traveling fast enough, these slits blur and due to the persistence of vision, multiple images from the series of lighted images appear to superimpose one over the other. By displaying images with slight changes, an animated effect is created from these passive displays. This explains the conventional thinking on passive lighted subway signage by viewing the image through a slit.

The subject of this invention however switches the foreground/background relationship of the slit and image so that the image is in the foreground and the equivalent of a slit, a narrow vertical light source, is in the background. The bare light source is viewed through the foreground image as the viewer passes the light box.

My earlier invention will now be described in connection with several especially preferred embodiments with references, where appropriate, to the Figures.

As already noted in the background of the invention, my earlier invention is especially well suited to use in subway tunnels where there is no natural light, where viewers are riding in a subway car at a relatively rapid speed (as compared, for example, to walking or running), and where signage has the ability to be viewed by a great many viewers as they travel through such tunnels.

A viewing box, LB, according to my invention may have one or more transparent images, I, and it is especially preferred that any such image(s) be protected by a transparent cover, TC. FIG. 3 illustrates a viewing box with one image, I, while FIG. 5 illustrates a viewing box with multiple images. When multiple images are aligned in parallel along a path of travel the images can be made to appear animated as a viewer moves past the images.

Each transparent image I in a viewing box according to my earlier invention is illuminated by its own substantially vertical light source, LS, of narrow width relative to the transparent image, the light source being located in the viewing box behind the transparent image, relative to the viewer. The vertical light source provides a line scan of the image as a viewer moves past the image, in much the same way as a slit provides a similar line scan when the slit is located between the viewer and the lighted image in a device such as is disclosed in U.S. Pat. No. 6,564,486 to Spodek et al. In contrast to Spodek in which the illumination is greatly attenuated by either being (1) reflected off of a front-lighted opaque print, or (2) transmitted through a back-lighted diffuser and image, both about 10% efficient, the present invention provides that the viewer is looking directly at the bare light source LS. To further illustrate the point, consider the difference in brightness of light that falls on a book from a reading lamp to looking at the bare hot tungsten filament of a clear light bulb in the reading lamp. This approximate 10:1 increase in brightness allows the subway signage of this invention to be illuminated, to the same level as Spodek, with a light source LS of approximately 10% of the energy requirements.

The vertical light source LS used in my earlier invention can take many forms, examples of which are illustrated in FIGS. 8-15. FIGS. 8 and 9 illustrate use of a narrow neon tube N. FIGS. 10 and 11 illustrate use of miniature fluorescent lamp MFL. FIGS. 12 and 13 illustrate use of a conventional fluorescent lamp FL, although not used efficiently, is advantageous due to the low cost and ready availability, whose output is limited by use of a wall with a slit S to create a substantially vertical light source of narrow width relative to the image I. This same concept, of limiting the width of the light source through use of a slit, can be used with other light sources as well, and it is an especially preferred way to achieve a desired narrow width vertical light source when its the cost is less than what might be required by using a very narrow vertical light source without a slit. FIGS. 14 and 15 illustrate use of a column of light emitting diodes, LEDs, mounted to a printed circuit board, PCB, while FIG. 16 illustrates such a column of LEDs in an especially preferred embodiment with the addition of a diffuser D which diffuses transmitted light exclusively in a vertical direction so as to fill in the gaps between individual LEDs to create the impression of a continuous unbroken vertical line of light. In each of these light sources, the width of the light source is narrow relative to the image so that it will create a vertical line scan of the image as a viewer moves laterally past the image.

The transparent image(s) can take many forms. For example, the transparent image may be a photographic film such as Agfa Cibachrome®, Kodak® Duraclear® or Endura® film, or a transparency that might be printed on a computer color printer or planar sheet of material such as transparent vinyl or Mylar® that may be obtained from rolls. To insure proper alignment of such a transparency within a viewing box the transparency can include one or more markings or registration holes for alignment with one or more registration pins RP (see, e.g., FIGS. 6 and 8-15) and, as is depicted in FIGS. 6 and 9, the viewing box can have a hinged frame HF connected by a hinge H to allow the transparent cover to be opened for ease of replacement of any transparency it holds.

As an alternative to a physical transparent image that must be replaced when the image is changed, the image can be formed by a transparent video display, V, such as an LCD video display with its typical backlight and omni-directional diffuser removed, or any other form of image display equivalent to such a display in the context of my invention in which the display is lit from within the display box but can be changed (or altered) without physically changing the actual display.

One advantage of a video display over a film image is that it can be updated remotely by an update signal. Such a signal can be delivered via a wired connection or via a wireless connection (see antennae FIG. 1, A) and the update signal can be based on any number of preselected criteria, such as, for example, a time interval. In an especially preferred embodiment, the update signal can be based upon detection of movement of the train past a box. Thus, for example, as shown in FIG. 1, a proximity sensor, PS, might be mounted on a viewing box attached to a tunnel wall, TW, for detecting movement of a train, T.

In an embodiment using a video display that can be updated remotely from the light box, the video display can be programmed so that passengers in different train or subway cars moving past it might actually see different images; in other words, passengers in the first car in a train might see a first image (such as an advertisement) while passengers in a second car of the train might see a second image or advertisement, and so on. As a result of such flexibility, an advertiser using such a system might be charged different rates for times of peak travel or the advertiser might be charged based upon the number of cars that pass by the viewing box(s) of a particular location, all of which create far more flexibility than can be obtained by use of film image, especially since the number of potential images that can be displayed, and their sequence and timing of display, can all be controlled electronically, instead of manually.

Another advantage of a video display over a physical transparent image is that its image can be individually adjusted remotely vertically and horizontally to make images register, image to image, when multiple display boxes are being used together to create a still or animated image. This is very important because if images in a series of boxes are not properly aligned the image or images that are being viewed appear to jump around. Also, the pace of the animated commercial can be adjusted to compensate for train speed, something that obviously cannot be done with a physical transparent image.

In connection with my earlier invention, it will usually be the case that multiple viewing boxes will be mounted along a path of travel past the boxes, even if the image to be displayed is only a still image. However, multiple images can be displayed in a single viewing box, as is illustrated in FIGS. 1 and 5, and this is especially preferred when the image is being displayed on a video display so as to maximize the use of such display. When multiple images are displayed in a single viewing box, each of the images must be lighted by its own substantially vertical light source. In such an embodiment, as shown in FIG. 4, it may be desirable to include a baffle, B, between individual light sources. The purpose of such a baffle is to eliminate possibly distracting side images created by a light source illuminating a neighboring or adjacent image. When the vertical light source is a series of LEDs, a baffle is usually not required because the support structure which supports the printed circuit board PCB, LED's and vertical diffuser D serves the purpose of a baffle that might be used otherwise with a miniature fluorescent lamp or neon tube.

Persistence of vision is such that the images will need to be pass the viewer frequently to prevent the perception of flicker. The minimum flicker frequency is approximately 18 Hz. Preferably, lighted images need to be refreshed at or above 48 Hz. A horizontal spacing, or image pitch IP, of 2.2 feet provides 20 images per second for a train traveling 30 miles per hour. By placing images closer than 2.2 feet, a higher frame rate is achieved and the illumination appears continuous. Particularly with the more expensive LCD video displays, it is important to use them efficiently and to take advantage of available image resolution. By choosing the image pitch IP and spacing between light boxes LB carefully the image pitch IP can be made uniform between multiple images within one light box and from light box to adjacent light box as shown in FIGS. 4 and 5. This assures a uniform and sufficiently high refresh rate so as to not see a vertical dark band sweep through the image as the train moves, and in general makes the image more comfortable and pleasant to view.

I will now turn to the improvement over my earlier invention that is disclosed in this continuation-in-part application.

So far this application has disclosed the new subway-tunnel signage system I described in my prior patent application U.S. Ser. No. 11/801,891 which requires tall, narrow light sources to back light the images. The images are visible to the commuters in the train because of the combination of motion parallax, persistence of vision and the horizontal line scanning of the images by the vertical light sources behind the front images.

My prior patent application describes several directly viewed vertical light sources, each with various advantages; however, one light source was required per image, and several increased the depth of the light box.

Subway regulations limit the maximum thickness of any such signage that reduces the clearance between the train and the tunnel wall. Proposed here is a compact, simple and economical lighting technique that alleviates several of the mentioned problems by reflecting light, from vertical light sources off vertical reflectors in the back of the light box. The vertical light source, typically a fluorescent lamp, is placed just behind the front image plane but also behind an opaque black baffle so that light is directed toward the reflectors at the back of the light box, and not into the viewers' eyes. The reflected light off each curved reflector becomes the light source for each image.

FIG. 21 shows a detailed ray trace from the fluorescent lamp light source LS with incident light IL onto reflective tube RT, with reflected light RL directed toward the film or video image I. Light is reflected off the reflective tube RT at a sufficient angle to fully illuminate the width of the image by line scanning the image due to motion parallax as the train moves laterally past the sign. Any and all diffusers traditionally associated with LCD video displays are removed from the LCD, making it a transparent image trapped between two sheets of glass G. The image is viewed by the train rider at a relatively large distance, therefore essentially only a vertical line of the image is back lighted and made visible to the train rider. Because the fluorescent lamp has a physical width, its reflection also has a physical width. FIGS. 22 and 23 show the location of the reflection on the reflective tube RT for the extreme right and left positions, respectively. By combining the ray traces of FIGS. 22 and 23 in FIG. 21, the equivalent position of the light-source reflection LSR can be determined. This light-source reflection LSR must be centered with respect to and behind each front image.

Further, the width of the light-source reflection LSR, the light-source width LSW, affects the image resolution. The wider the LSW, the lower the horizontal image resolution but the brighter the image. The narrower the LSW, the sharper the horizontal image resolution, but the dimmer the image. In the case of displaying a video image, using a liquid-crystal display LCD, the light-source width LSW can be as wide as one column of pixels of the LCD without compromising the image resolution. To have the light-source width narrower than a single column of pixels would unnecessarily dim the image.

The light box LB is assembled with modules comprised of one light source and multiple reflective rods, and their associated baffles. Each module is designed so that each light-source reflection LSR is centered with its corresponding film or video image. The lateral spacing of images determines the lateral spacing of the reflective tubes RT, reflective surfaces RS or strips of reflective film RF. Because the light-source reflections LSR occur at different portions of alternate rods (approximately the 5 o'clock or 7 o'clock positions), the modules are spaced so that the light-source reflections LSR between reflective rods of adjacent modules are maintained uniformly across the width of the light box LB.

Because each light source can reflect off multiple reflectors, only a fraction as many light sources are required, reducing lamp replacement cost, electricity, heat and the need for cooling fans.

The reflectors at the back of the box could be solid rods, not shown, or hollow tubes as in FIGS. 18-23 or rounded shapes stamped in the back of a reflective sheet metal light box as in FIGS. 24 and 25, or bent reflective film RF as in FIGS. 26-30. Hollow tubes are preferred to solid rods due to their reduced weight and cost, non-directional mechanical stability, and ease of mounting by their top and bottom ends. The tubes could be any reflective material, i.e. polished stainless steel, mirrored glass, chrome-plated steel tubes, etc.

The curvature of all reflectors discussed here narrows the width of the light-source reflection LSR without affecting the vertical length, the height, of the reflection. The width of the light-source reflection LSR is easily changed during the design stage by (a) using a different curvature reflector, (b) different diameter fluorescent lamp, or (c) altering the distance between the lamp and reflector.

FIGS. 24 and 25 show a light box RLB made of a reflective material such as Alzak aluminum, polished stainless steel, or chrome-plated steel which has had it's back wall stamped with vertical, rounded stamped indentions SI's which replace the chrome-plated tubes and provide vertical reflectors to reflect the light sources. For light control, the majority of the inner walls of the reflective light box RLB are blackened with flat black paint, or by attaching adhesive backed black velvet, to the back wall, with cutouts to reveal the reflective stamped indentation SI. An alternate way to paint the back wall is by a shallow dipping into flat-black paint to coat the flat areas but reveal the linear reflectors.

It is important that only one bright reflection appear behind each film or video image. Therefore, light control within the light box LB is important, which is why a "V" shaped light-source baffle LSB shown in FIGS. 18-30 is placed between the light source and the viewer.

An internal reflection barrier IRB shown in FIGS. 18 & 20-27 is placed behind the lamps with enough gap between it and the "V"-shaped light-source baffle LSB to allow light to illuminate the reflectors RT, RS or RF.

Further, an additional baffle, the internal-reflection barrier IRB is placed between the pairs of reflectors to prevent secondary reflections, first off one reflector, then onto an adjacent reflector, creating an undesirable "false" reflected light source, and thereby a ghost image to the train rider. As shown in FIGS. 18, 20, 24-27 because of the relatively large light source LS, reflective surface RS and confined space, some spill light is inevitable on the back wall of the light box. All interior surfaces not needed for reflection should be as black and light absorbing as possible. Various approaches include making the light boxes and baffles from black anodized aluminum, or using flat-black paint and/or covering surfaces with black velvet.

FIGS. 24 and 25 show adhesive-backed black velvet VEL attached to the interior back and side wall of a reflective light box RLB, leaving reveals in the areas of the vertical stamped indentations SI which serve as the reflectors for the light sources. FIG. 24*a* is an enlarged section through a light box showing at left a magnified view of the adhesive-backed velvet VEL attached to the back wall. In the central portion of FIG. 24*a*, an alternate technique to simplify assembly is shown by attaching black velvet VEL to a strip of velvet-backing material VBM which has been fitted with snap fasteners SF, used to attach that strip to the back metal wall of the light box LB. The widths of the strips of vertical backing material VBM are dimensioned such that they self align between the stamped indentations SI so that only the crowns of the stamped indentations are revealed.

FIGS. 26 and 27 show an alternate light box LB made with small tabs TAB stamped into the back of the metal light box LB to which reflective film RF is attached. The strips are reflective plastic film, made by aluminizing rolls of Mylar or other plastic of the appropriate width so that when cut to the required length, can be curved and snapped between the tabs to form an approximate cylindrical shape. The edges of the plastic strips may bow out slightly between securing tabs TAB; however, the front crown is straight and provides a very accurate linear reflector. The geometry of the reflective strip, although not completely straight on the sides, is straight in the middle for two reasons: (1) the averaging effect of equal and opposite lateral deformations at the tabs TAB on opposite sides, and (2) flat materials when bent can curve exclusively around one axis, in this example generally cylindrically. This technique makes it very easy to change the width of the light-source reflection LSR shown in FIGS. 19-21, 25, 27 and 29, and as light-source width LSW in FIGS. 21-23 by changing the width of the reflective film RF, shown in FIGS. 26-30, or the lateral space between tabs TAB shown in FIGS. 26 and 27.

FIGS. 28-30 show extruded reflector supports ERS, made preferably of black plastic, or aluminum with black anodized finish or painted with flat black paint. The extruded-reflector supports ERS are shown attached to the back wall of the light box LB with snap fasteners SF. Each extruded reflector support ERS has vertical channels C into which flexible-reflective strips, typically aluminized Mylar plastic, are bent into a curve and inserted to form linear reflective surfaces RS. As in FIGS. 26-30, the width of the reflective film RF, or the width of the channels C, will determine the curvature of the reflective strips and therefore the width of the light-source reflection LSR.

FIGS. 28-30 show the inner walls IW of the extrusions which serve the same function as the internal-reflection barrier IRB in FIGS. 18 and 20-23 by blocking the internal reflection that would reflect off one reflector, then onto the adjacent reflector and then out through the image, creating a false ghost image in addition to the brighter primary image.

In FIGS. 27-30, on the extrusion ERS, the space between the walls, adjacent to any strip of reflective film RF, is sufficient to allow incident from the light source LS and reflected light from the reflective strip to the image, but as narrow as possible to trap and minimize scatter light within the light box LB.

FIG. 31 is similar to FIG. 24 in that the light box LB is stamped with indentations SI from the back. FIG. 31 is to show an alternate construction to achieve the reflective surfaces RS and black light control velvet VEL. In this case, the light box LB material itself need not be reflective and, in fact, is preferably black. Instead, reflective film RF for example aluminized Mylar™ is "wall papered" or attached to the interior wall of the box by fitting strips of stiff flat velvet covered backing material VBM to the back wall so that it traps the reflective film RF and forces the film to conform to the curvature of the protrusions (made by the stamped indentations SI). In advance, the Mylar is die cut with holes that align with holes in the light box and the snap fasteners SF in the velvet backing material. The backing material is cut in vertical strips approximately the interior height of the box but the width is such that it forces the Mylar tightly against the protrusions. This approach speeds up the assembly and leaves the interior extremely black with excellent light control, revealing the reflective Mylar only in the areas that are needed to reflect the light source LS.

FIG. 32 is a perspective view of FIG. 31, which shows the assembly of the reflective film RF being trapped by black-velvet covered backing material which forces the reflective film to wrap around, and therefore conform to, the curvature of the stamped indentations SI. This assembly technique is quick and accurate and provides excellent light control and reveals the reflective film RF only in areas that are needed to reflect the light sources LS. Typically, the light box LB would have many light sources LS, strips of velvet-backing material VBM, and exposed columns of reflective film RF; however only a portion of the interior of the light box LB is shown.

When the fluorescent lamp light sources LS need to be replaced, the front door DR of the light box LB hinges open, carrying the LCD video display (or film image), hinged on a hinge typically horizontal and at the bottom, carrying with it the "V"-shaped baffles LSB and SB, leaving the lamps accessible for replacement.

In theory, numerous reflected-light sources RLS can be generated by reflecting light from a single light source off multiple reflectors. FIG. 30 shows an expanded module in which one lamp illuminates four reflective flexible strips, requiring one fourth the number of lamps compared to the lamps being viewed directly. As suggested by FIG. 30, when generating multiple light-source reflections LSR, while not essential, it is more practical to have a symmetrical layout where there are equal numbers of reflective surfaces RS on both sides of the light source LS. When the layout is symmetrical, the light source LS "hides" between the inner two reflective surfaces RS in an out-of-the-way position behind the light source baffle LSB.

It is important that the light-source width LSW, in FIGS. 21-23, be equal, and that the reflected light pitch RLP, in FIGS. 18 & 30, be equal. As in FIG. 30, the geometry of the light source LS and the inner two strips of reflective film RF2 and RF3 in are identical in width LSW to those of strips of reflective film RF1 and RF4. However, in FIG. 30, the outer strips of reflective film RF1 and RF4 are farther from the light source, therefore the radius of curvature of RF1 and RF4 is increased to compensate and preserve the width of the light-source reflection LSR, FIG. 21.

In FIG. 30, the edges of the light source baffle LSB, side baffles SB, and inner and outer walls, IW and OW, respectively, of the extruded reflector support ERS are dimensioned so as to allow light from the light source to illuminate the strips of reflective film; however, minimize stray light and internal reflections.

While the invention has been described herein with reference to certain preferred embodiments, those embodiments have been presented by way of example only, and not to limit the scope of the invention. Additional embodiments thereof will be obvious to those skilled in the art having the benefit of this detailed description. Further, modifications are also possible in alternative embodiments without departing from the inventive concept.

Accordingly, it will be apparent to those skilled in the art that still further changes and modifications in the actual concepts described herein can readily be made without departing from the spirit and scope of the disclosed inventions as defined by the following claims.

What is claimed is:

1. Apparatus for displaying a back-lighted image to a viewer moving along a path of travel past a viewing display, comprising:

a viewing box;

a transparent video display for displaying a first and a second transparent image;

a substantially vertical light source located in the viewing box behind the first and second transparent images, relative to the viewer;

a first curved reflector about a vertical axis in a convex shape for providing substantially vertical reflected light from the substantially vertical light source of narrow width relative to the first transparent image, said first reflector being located in the viewing box behind the first transparent image, relative to the viewer;

a second curved reflector about a vertical axis in a convex shape for providing substantially vertical reflected light from the substantially vertical light source of narrow width relative to the second transparent image, said second reflector being located in the viewing box behind the first transparent image, relative to the viewer; and wherein light from the substantially vertical light source is blocked from directly illuminating either the first or the second transparent images.

2. The apparatus of claim 1, wherein the transparent video display is an LCD video display.

3. The apparatus of claim 2, wherein the substantially vertical reflected light provided to the first and the second reflectors has a width of approximately one column of pixels of the LCD video display.

4. The apparatus of claim 3, wherein the substantially vertical light source is comprised of a column of light emitting diodes.

5. The apparatus of claim 1, wherein the substantially vertical light source is a fluorescent lamp.

6. The apparatus of claim 1, wherein the convex shape is a cylindrical shape.

7. The apparatus of claim 6, wherein the first and second reflectors are selected from the group consisting of a reflective rod, a reflective tube and a rounded shape stamped in a reflective sheet.

8. The apparatus of claim 1, wherein the first and second reflectors are spaced equidistant from the substantially vertical light source.

9. The apparatus of claim 1, wherein only one bright reflection appears behind each of the first and second transparent images.

10. The apparatus of claim 1, further comprising:

a baffle placed between the first and second reflectors to prevent secondary reflections.

11. The apparatus of claim 1, further comprising:

a baffle located between the substantially vertical light source and the first and second transparent images.

12. The apparatus of claim 11, wherein the baffle is an opaque black baffle.

13. The apparatus of claim 1, further comprising:

a plurality of the viewing displays aligned parallel to a path of travel with the plurality of transparent images so as to create an effect of moving images as the viewer moves past the plurality of the viewing displays.

14. A method for displaying a back-lighted image to one or more viewers moving along a path of travel past a viewing display, comprising the steps of:

placing a viewing box with a transparent video display for displaying a first and a second transparent image parallel to the path of travel; and illuminating the first and second transparent images with a reflected light reflected off of a curved reflector about a vertical axis in a convex shape, said reflected light being located in the viewing box behind the video display, relative to the viewer.

15. The method of claim 14, wherein the transparent video display is an LCD video display.

16. The method of claim 15, wherein the reflected light has a width of approximately one column of pixels of the LCD video display.

17. A method for displaying a back-lighted image to one or more viewers moving along a path of travel past a viewing display, comprising the steps of:

placing a viewing box with an LCD video display for displaying a first and a second transparent image parallel to the path of travel; and illuminating each of the first and second transparent images with a light having a width of approximately one column of pixels of the LCD video display, said light being located in the viewing box behind the LCD video display, relative to the viewer.

18. The method of 16, wherein each of the first and second transparent images is illuminated by a column of light emitting diodes.

* * * * *